US010219083B2

(12) United States Patent
Farmani et al.

(10) Patent No.: US 10,219,083 B2
(45) Date of Patent: Feb. 26, 2019

(54) METHOD OF LOCALIZING A SOUND SOURCE, A HEARING DEVICE, AND A HEARING SYSTEM

(71) Applicant: Oticon A/S, Smørum (DK)

(72) Inventors: Mojtaba Farmani, Smørum (DK); Michael Syskind Pedersen, Smørum (DK); Jesper Jensen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 15/915,734

(22) Filed: Mar. 8, 2018

(65) Prior Publication Data

US 2018/0262849 A1 Sep. 13, 2018

(30) Foreign Application Priority Data

Mar. 9, 2017 (EP) ..... 17160114

(51) Int. Cl.
*H04R 5/00* (2006.01)
*H04R 25/00* (2006.01)
(Continued)

(52) U.S. Cl.
CPC ..... *H04R 25/552* (2013.01); *H04R 1/1083* (2013.01); *H04R 3/005* (2013.01);
(Continued)

(58) Field of Classification Search
CPC .... H04R 25/552; H04R 1/1083; H04R 3/005; H04R 25/407
See application file for complete search history.

(56) References Cited

U.S. PATENT DOCUMENTS 9,549,253 B2 * 1/2017 Alexandridis ..... H04R 3/005
2007/0016267 A1 * 1/2007 Griffin ..... A61N 1/36032 607/57
(Continued)

FOREIGN PATENT DOCUMENTS

EP 3 013 070 A2 4/2016
EP 3 013 070 A3 6/2016
EP 3 157 268 A1 4/2017

OTHER PUBLICATIONS

Farmani et al., "Informed Sound Source Localization Using Relative Transfer Functions for Hearing Aid Applications", IEEE/ACM Transaction on Audio, Speech, and Language Processing, vol. 25, No. 3, Mar. 2017, pp. 611-623.
(Continued)

*Primary Examiner* — Simon King
(74) *Attorney, Agent, or Firm* — Birch, Stewart, Kolasch & Birch, LLP

(57) ABSTRACT

A hearing system comprising a) a multitude M of microphones, M≥2, adapted for picking up sound from the environment and to provide corresponding electric input signals $r_m(n)$, m=1, . . . , M, n representing time, $r_m(n)$ comprising a mixture of a target sound signal propagated via an acoustic propagation channel and possible additive noise signals $v_m(n)$; b) a transceiver configured to receive a wirelessly transmitted version of the target sound signal and providing an essentially noise-free target signal s(n); c) a signal processor configured to estimate a direction-of-arrival of the target sound signal relative to the user based on c1) a signal model for a received sound signal $r_m$ at microphone m through the acoustic propagation channel, wherein the $m^{th}$ acoustic propagation channel subjects the essentially noise-free target signal s(n) to an attenuation $\alpha_m$ and a delay $D_m$; c2) a maximum likelihood methodology; and c3) relative transfer functions $d_m$ representing direction-dependent fil-
(Continued)

tering effects of the head and torso of the user in the form of direction-dependent acoustic transfer functions from each of M−1 of said M microphones (m=1, . . . , M, m≠j) to a reference microphone (m=j) among said M microphones, wherein it is assumed that the attenuation $\alpha_m$ is frequency independent whereas the delay $D_m$ may be frequency dependent. The application further relates to a method. Embodiments of the disclosure may e.g. be useful in applications such as binaural hearing systems, e.g. binaural hearing aids systems.

20 Claims, 13 Drawing Sheets

(51) Int. Cl.
*H04R 1/10* (2006.01)
*H04R 3/00* (2006.01)
*H04S 7/00* (2006.01)

(52) U.S. Cl.
CPC ..... *H04R 25/407* (2013.01); *H04R 25/43* (2013.01); *H04R 25/554* (2013.01); *H04R 2225/43* (2013.01); *H04R 2430/23* (2013.01); *H04S 7/302* (2013.01); *H04S 2420/01* (2013.01)

(56) References Cited

U.S. PATENT DOCUMENTS

2015/0213811 A1* 7/2015 Elko ..... H04R 3/005 381/92
2015/0289064 A1* 10/2015 Jensen ..... H04R 25/30 381/317

OTHER PUBLICATIONS

Rui et al., "Bias Compensation for Target Tracking from Range Based Maximum Likelihood Position Estimates", 2012 IEEE 7th Sensor Array and Multichannel Signal Processing Workshop (SAM), 2012, pp. 193-196.

* cited by examiner

METHOD OF LOCALIZING A SOUND SOURCE, A HEARING DEVICE, AND A HEARING SYSTEM

SUMMARY

The present disclosure deals with the problem of estimating the direction to one or more sound sources of interest—relative to a hearing device or to a pair of hearing devices (or relative to the nose) of a user. In the following the hearing device is exemplified by a hearing aid adapted for compensating a hearing impairment of its user. It is assumed that the target sound sources are equipped with (or provided by respective devices having) wireless transmission capabilities and that the target sound is transmitted via thus established wireless link(s) to the hearing aid(s) of the hearing aid user. Hence, the hearing aid system receives the target sound(s) acoustically via its microphones, and wirelessly, e.g., via an electromagnetic transmission channel (or other wireless transmission options). A hearing device or a hearing aid system according to the present disclosure may operate in a monaural configuration (only microphones in one hearing aid are used for localization) and a binaural configuration (microphones in two hearing aids are used for localization) or in a variety of hybrid solutions comprising at least two microphones 'anywhere' (on or near a user's body, e.g. head, preferably maintaining direction to source even when the head is moved). Preferably, the at least two microphone are located in such a way (e.g. at least one microphone at each ear) that they exploit the different position of the ears relative to a sound source (considering the possible shadowing effects of the head and body of the user). In the binaural configuration, it is assumed that information can be shared between the two hearing aids, e.g., via a wireless transmission system.

In an aspect, a binaural hearing system comprising left and right hearing devices, e.g. hearing aids, is provided. The left and right hearing devices are adapted to exchange likelihood values L or probabilities p, or the like, between the left and right hearing devices for use in an estimation of a direction of arrival (DoA) to/from a target sound source. In an embodiment, only likelihood values ($L(\theta_i)$)), e.g. log likelihood values, or otherwise normalized likelihood values) for a number of direction of arrivals DoA ($\theta$), e.g. qualified to a limited (realistic) angular range, e.g. $\theta\varepsilon[\theta_1; \theta_2]$, and/or limited to a frequency range, e.g. below a threshold frequency, are exchanged between the left and right hearing devices ($HD_L$, $HD_R$). In its most general form, only noisy signals are available, e.g. as picked up by microphones of the left and right hearing devices. In a more specific embodiment, an essentially noise-free version of a target signal is available, e.g. wirelessly received from the corresponding target sound source. The general aspect can be combined with features of a more focused aspect as outlined in the following.

Given i) the received acoustical signal which consists of the target sound and potential background noise, and ii) the wirelessly received target sound signal, which is (essentially) noise-free, because the wireless microphone is close to the target sound source (or obtained from a distance, e.g. by a (wireless) microphone array using beamforming), the goal of the present disclosure is to estimate the direction-of-arrival (DOA) of the target sound source, relative to the hearing aid or hearing aid system. The term 'noise free' is in the present context (the wirelessly propagated target signal) taken to mean 'essentially noise-free' or 'comprising less noise than the acoustically propagated target sound'.

The target sound source may e.g. comprise a voice of a person, either directly from the persons' mouth or presented via a loudspeaker. Pickup of a target sound source and wireless transmission to the hearing aids may e.g. be implemented as a wireless microphone attached to or located near the target sound source (see e.g. FIG. 1A, or FIG. 5-8), e.g. located on a conversation partner in a noisy environment (e.g. a cocktail party, in a car cabin, plane cabin, etc.), or located on a lecturer in a "lecture-hall or classroom situation", etc. The target sound source may also comprise music or other sound played live or presented via one or more loudspeakers (while being simultaneously wirelessly transmitted (either directly or broadcasted) to the hearing device). The target sound source may also be a communication and/or entertainment device with wireless transmission capability, e.g. a radio/TV comprising a transmitter, which transmits the sound signal wirelessly to the hearing aid(s).

Typically, an external microphone unit (e.g. comprising a microphone array) will be placed in the acoustic far-field with respect to a hearing device (cf. e.g. scenarios of FIG. 5-8). It may be preferable to use a distance measure (e.g. near-field versus far-field discrimination) and an appropriate distance criterion depending on the distance measure in a hearing device to decide whether wireless reception of a signal from the external microphone unit should have preference over microphone signals of hearing device(s) located at the user. In an embodiment, cross correlation between the wirelessly received signal from the external microphone unit and the electric signals picked up by the microphones of the hearing device can be used to estimate a mutual distance (by extracting a difference in time of arrival of the respective corresponding signals at the hearing device, taking into account processing delays on the transmitting and receiving side). In an embodiment, the distance criterion comprises to ignore the wireless signal (and use the microphones of the hearing device), if the distance measure indicates a distance of less than a predetermined distance, e.g. less than 1.5 m, or less than 1 m, between the external microphone unit and the hearing device(s). In an embodiment, a gradual fading between using the signal from microphones of the hearing device and using the signal from the external microphone unit for increasing distance between the hearing device and the external microphone unit is implemented. The respective signals are preferably aligned in time during fading. In an embodiment, the microphones of the hearing device(s) are mainly used for distances less than 1.5 m, whereas the external microphone unit is mainly used for distances larger than 3 m (preferably taking reverberation into account).

It is advantageous to estimate the direction to (and/or location) of the target sound sources for several purposes: 1) the target sound source may be "binauralized" i.e., processed and presented binaurally to the hearing aid user with correct spatial information—in this way, the wireless signal will sound as if originating from the correct spatial position, 2) noise reduction algorithms in the hearing aid system may be adapted to the presence of this known target sound source at this known position, 3) visual (or by other means) feedback may be provided—e.g., via a portable computer—to the hearing aid user about the location of the sound source(s) (e.g. wireless microphone(s)), either as simple information or as part of a user interface, where the hearing aid user can control the appearance (volume, etc.) of the various wireless sound sources, 4) a target cancelling beamformer with a precise target direction may be created by hearing device microphones and the resulting target-cancelled signal ($TC_{mic}$) may be mixed with the wirelessly received target signal(s) ($T_{w1}$, e.g. provided with spatial cues, $T_{w1}*d_m$, $d_m$ being a relative transfer function (RTF) and m=left, right, as the case may be) in left and right hearing devices, e.g. to provide a resulting signal with spatial cues as well as room ambience for presentation to a user (or for further processing), e.g. as $\alpha \cdot T_{w1} * d_m + (1-\alpha) \cdot TC_{mic}$), where a is a weighting factor between 0 and 1 This concept is further described in our co-pending European patent application [5].

In the present context, the term (acoustic) 'far-field' is taken to refer to a sound field, where the distance from the sound source to the (hearing aid) microphones is much greater than the inter-microphone distance.

Our co-pending European patent applications [2], [3], [4], also deal with the topic of sound source localization in a hearing device, e.g. a hearing aid.

Compared to the latter disclosure, embodiments of the present disclosure may have one or more of the following advantages:

- The proposed method works for any number of microphones (in addition to the wireless microphone(s) picking up the target signal) M≥2 (located anywhere at the head), in both monaural and binaural configurations, whereas [4] describes an M=2 system with exactly one microphone in/at each ear.
- The proposed method is computationally cheaper, as it requires a summation across frequency spectra, whereas [4] requires an inverse FFT to be applied to frequency spectra.
- A variant of the proposed method uses an information fusion technique which facilitates reduction of the necessary binaural information exchange. Specifically, whereas [4] requires binaural transmission of microphone signals, a particular variant of the proposed method only requires an exchange of I posterior probabilities per frame, where I is the number of possible directions that can be detected. Typically, I is much smaller than the signal frame length.
- A variant of the proposed method is bias-compensated, i.e., when the signal to noise ratio (SNR) is very low, it is ensured that the method does not "prefer" particular directions—this is a desirable feature of any localization algorithm. In an embodiment, a preferred (default) direction may advantageously be introduced, when the bias has been removed.

An object of the present disclosure is to estimate the direction to and/or location of a target sound source relative to a user wearing a hearing aid system comprising microphones located at the user, e.g. at one or both of the left and right ears of the user (and/or elsewhere on the body (e.g. the head) of the user).

In the present disclosure, the parameter θ is intended to mean the azimuthal angle θ compared to a reference direction in a reference (e.g. horizontal) plane, but may also be taken to include an out of plane (e.g. polar angle φ) variation and/or a radial distance (r) variation. The distance variation may in particular be of relevance for the relative transfer functions (RTF), if the target sound source is in the acoustic near-field with respect to the user of the hearing system.

To estimate the location of and/or direction to the target sound source, assumptions are made about the signals reaching the microphones of the hearing aid system and about their propagation from the emitting target source to the microphones. In the following, these assumptions are briefly outlined. Reference is made to [1] for more detail on this and other topics related to the present disclosure. In the following, equation numbers '(p)' correspond to the outline in [1].

Signal Model:

A signal model of the form:

$$r_m(n)=s(n)*h_m(n,\theta)+v_m(n),(m=1, \ldots ,M) \quad \text{Eq. (1)}$$

is assumed, where M denotes the number of microphones (M≥2), s(n) is noise-free target signal emitted at the target sound source location, and $h_m(n, \theta)$ is the acoustic channel impulse response between the target sound source and the $m^{th}$ microphone, and $v_m(n)$ represents (an) additive noise component(s), respectively. We operate in the short-time Fourier transform domain, which allows all involved quantities to be written as functions of a frequency index k, a time (frame) index l, and the direction-of-arrival (angle, distance, etc.) θ. The Fourier transforms of the noisy signal $r_m(n)$ and the acoustic transfer function $h_m(n, \theta)$ are given by Eqs. (2) and (3), respectively.

It is well-known that the presence of the head influences the sound before it reaches the microphones of a hearing aid, depending on the direction of the sound. The proposed method takes the head presence into account to estimate the target position. In the proposed method, the direction-dependent filtering effects of the head is represented by relative transfer functions (RTFs), i.e., the (direction-dependent) acoustic transfer function from microphone m to a preselected reference microphone (with index j, m, jεM). For a particular frequency and direction-of-arrival, the relative transfer function is a complex-valued quantity, denoted as $d_m(k, \theta)$ (cf. Eq. (4) below). We assume that RTFs $d_m(k, \theta)$ are measured for relevant frequencies k and directions θ, for all microphones m in an offline measurement procedure, e.g. in a sound studio using hearing aids (comprising the microphones) mounted on a head-and-torso-simulator (HATS), or on a real person, e.g. the user of the hearing system. RTFs for all microphones, m=1, . . . , M (for a particular angle θ and a particular frequency k) are stacked in M-dimensional vectors d(k, θ). These measured RTF vectors d(k, θ) (e.g. d(k, θ, φ, r)) are e.g. stored in a memory of (or otherwise available to) the hearing aid.

Finally, stacking the Fourier transforms of the noisy signals for each of the M microphones in an M-dimensional vector R(l,k) leads to eq. (5) below.

Maximum Likelihood Framework:

The general goal is to estimate the direction-of-arrival θ using a maximum likelihood framework. To this end, we assume that the (complex-valued) noisy DFT coefficients follow a Gaussian distribution, cf. Eq.(6).

Assuming that noisy DFT coefficients are statistically independent across frequency k allows us to write the likelihood function p for a given frame (with index l), cf. Eq.(7) (using the definitions in the un-numbered equations following eq. (7)).

Discarding terms in the expression for the likelihood function that do not depend on θ, and operating on the log of the likelihood value L, rather than the likelihood value p itself, we arrive at Eq.(8), cf. below.

Proposed DoA Estimator:

The basic idea of the proposed DoA estimator is to evaluate all the pre-stored RTF vectors $d_m(k, \theta)$ in the log-likelihood function (eq. (8)), and select the one that leads to largest likelihood. Assuming that the magnitude of the acoustic transfer function $H_j(k, \theta)$ (cf. Eq. (3), (4)), from the target source to the reference microphone (the $j^{th}$ microphone) is frequency independent, it may be shown that the log-likelihood function L may be reduced (cf. eq. (18)). Hence, to find the maximum likelihood estimate of θ, we simply need to evaluate each and every of the pre-stored RTF-vectors in the expression for L (eq. (18)) and select the one that maximizes L. It should be noted that the expression for L has the very desirable property that it involves a summation across the frequency variable k. Other methods (e.g. the one in our co-pending European patent application 16182987.4 [4]) requires the evaluation of an inverse Fourier transformation. Clearly, a summation across the frequency axis is computationally less expensive than a Fourier transform across the same frequency axis.

The proposed DOA-estimator $\hat{\theta}$ is compactly written in eq. (19). Steps of the DoA estimation comprise 1) evaluating the reduced log-likelihood function L among the pre-stored set of RTF vectors, and
2) identifying the one leading to maximum log-likelihood. The DOA associated with this set of RTF vectors is the maximum likelihood estimate.

Bias Compensated Estimator.

At very low SNRs, i.e., situations where there is essentially no evidence of the target direction, it is desirable that the proposed estimator (or any other estimator for that matter) does not systematically pick one direction—in other words, it is desirable that the resulting DOA estimates are distributed uniformly in space. A modified (bias-compensated) estimator as proposed in the present disclosure (and defined in eq. (29)-(30)) results in DOA estimates that are uniformly distributed in space. In an embodiment, the dictionary elements of pre-stored RTF vectors $d_m(k, \theta)$ are uniformly distributed in space (possibly uniformly over azimuthal angle $\theta$, or over $(\theta, \varphi, r)$).

The procedure to finding the maximum-likelihood estimate $\hat{\theta}$ of the DOA (or $\theta$) with the modified log-likelihood function is similar to the one described above.

1) Evaluate the bias-compensated log-likelihood function L for RTF vectors associated with each direction $\theta_i$, and
2) Select the $\theta$ associated with the maximizing RTF vectors as the maximum likelihood estimate $\hat{\theta}$.

Reducing Binaural Information Exchange.

The proposed method is general—it can be applied to any number of microphones $M \geq 2$ (on the head of the user), irrespective of their position (e.g. at least two microphones located at one ear of a user, or distributed on both ears of the user). Preferably, the inter-microphone distances are relatively small (e.g. smaller than a maximum distance) to keep a distance dependence of the relative transfer functions at a minimum. In situations where microphones are located at both sides of the head, the methods considered so far require that microphone signals are somehow transmitted from one side to the other. In some situations, the bit-rate/latency of this binaural transmission path is constrained, so that transmission of one or more microphone signals is difficult. In an embodiment, at least one, such as two or more, or all, of the microphones of the hearing system are located on a head band or on spectacles, e.g. on a spectacle frame, or on other wearable items, e.g. a cap.

The present disclosure proposes a method which avoids transmission of microphone signals. Instead it transmits—for each frame —posterior (conditional) probabilities (cf. eq. (31) or (32)) to the right and left side, respectively. These posterior probabilities describe the probability that the target signal originates from each of I directions, where I is the number of possible DoAs represented in the pre-stored RTF data base. Typically, the number I is much smaller than a frame length—hence, it is expected that the data rate needed to transmit I is smaller than the data rate needed to transmit one or more microphone signals.

In summary, this special binary version of the proposed method requires:

1) On the transmitting side: Computation and transmission of posterior probabilities (e.g., eq. (31) for the left side) for each direction $\theta_i$, $i=0, \ldots, I-1$, for each frame.
2) On the receiving side: Computation of posterior probabilities (cf. eq. (32)), and multiplication with received posterior probabilities ($p_{left}$, $p_{right}$, cf. eq. (33)) to form an estimate of the global likelihood function, for each direction $\theta_i$.
3) Selecting the $\theta_i$ associated with the maximum of eq. (33) as the maximum likelihood estimate (as shown in eq. (34)).

A Hearing System:

In an aspect of the present application, a hearing system is provided. The hearing system comprises a multitude of M of microphones, where M is larger than or equal to two, adapted for being located on a user and for picking up sound from the environment and to provide M corresponding electric input signals $r_m(n)$, $m=1, \ldots, M$, n representing time, the environment sound at a given microphone comprising a mixture of a target sound signal propagated via an acoustic propagation channel from a location of a target sound source and possible additive noise signals $v_m(n)$ as present at the location of the microphone in question;

a transceiver configured to receive a wirelessly transmitted version of the target sound signal and providing an essentially noise-free target signal s(n);

a signal processor connected to said number of microphones and to said wireless transceiver, the signal processor being configured to estimate a direction-of-arrival of the target sound signal relative to the user based on a signal model for a received sound signal $r_m$ at microphone m ($m=1, \ldots, M$) through the acoustic propagation channel from the target sound source to the $m^{th}$ microphone when worn by the user, wherein the $m^{th}$ acoustic propagation channel subjects the essentially noise-free target signal s(n) to an attenuation $\alpha_m$ and a delay $D_m$;

a maximum likelihood methodology;

relative transfer functions $d_m$ representing direction-dependent filtering effects of the head and torso of the user in the form of direction-dependent acoustic transfer functions from each of M−1 of said M microphones ($m=1, \ldots, M$, $m \neq j$) to a reference microphone ($m=j$) among said M microphones.

The signal processor is further configured to estimate a direction-of-arrival of the target sound signal relative to the user under the assumption that said attenuation $\alpha_m$ is independent of frequency whereas said delay $D_m$ may be (or is) frequency dependent.

The attenuation $\alpha_m$ refers to an attenuation of a magnitude of the signal when propagated through the acoustic channel from the target sound source to the $m^{th}$ microphone (e.g. the reference microphone j), and $D_m$ is the corresponding delay of the channel that the signal experiences while travelling in the channel from the target sound source to the $m^{th}$ microphone.

The independence of frequency of attenuation $\alpha_m$ provides the advantage of computational simplicity (because calculations can be simplified, e.g. in the evaluation of a log likelihood L, a sum over all frequency bins can be used instead of computing an inverse Fourier transformation (e.g.

an IDFT)). This is generally of importance in portable devices, e.g. hearing aids, where power issues are of a mayor concern.

Thereby an improved hearing system may be provided.

In an embodiment, the hearing system is configured to simultaneously wirelessly receive two or more target sound signals (from respective two or more target sound sources).

In an embodiment, the signal model can be (is) expressed as $$r_m(n)=s(n)*h_m(n,\theta)+v_m(n),(m=1, \ldots ,M)$$

where s(n) is the essentially noise-free target signal emitted by the target sound source, $h_m(n, \theta)$ is the acoustic channel impulse response between the target sound source and microphone m, and $v_m(n)$ is an additive noise component, θ is an angle of a direction-of-arrival of the target sound source relative to a reference direction defined by the user and/or by the location of the microphones at the user, n is a discrete time index, and * is the convolution operator.

In an embodiment, the signal model can be (is) expressed as $$R_m(l,k)=S(l,k)H_m(k,\theta)+V_m(l,k)(m=1, \ldots ,M)$$

where $R_m(l,k)$ is a time-frequency representation of the noisy target signal, S(l,k) is a time-frequency representation of the essentially noise-free target signal, $H_m(k, \theta)$ is a frequency transfer function of the acoustic propagation channel from the target sound source to the respective microphones, and $V_m(l,k)$ is a time-frequency representation of the additive noise.

In an embodiment, the hearing system is configured to provide that the signal processor has access to a database Θ of relative transfer functions $d_m(k)$ for different directions (θ) relative to the user (e.g. via memory or a network).

In an embodiment, the database of relative transfer functions $d_m(k)$ is stored in a memory of the hearing system.

In an embodiment, the hearing system comprises at least one hearing device, e.g. a hearing aid, adapted for being worn at or in an ear, or for being fully or partially implanted in the head at an ear, of a user. In an embodiment, the at least one hearing device comprises at least one, such as at least some (such as a majority or all) of said multitude of M of microphones.

In an embodiment, the hearing system comprises left and right hearing devices, e.g. hearing aids, adapted for being worn at or in left and right ears, respectively, of a user, or for being fully or partially implanted in the head at the left and right ears, respectively, of the user. In an embodiment, the left and right hearing devices comprise at least one, such as at least some (such as a majority or all) of said multitude of M of microphones. In an embodiment, the hearing system is configured to provide that said left and right hearing devices, and said signal processor are located in or constituted by three physically separate devices.

The term 'physically separate devices' is in the present context taken to mean that each device has its own separate housing and that the devices—if in communication with each other—are connected via wired or wireless communication links.

In an embodiment, the hearing system is configured to provide that each of said left and right hearing devices comprise a signal processor, and appropriate antenna and transceiver circuitry to provide that information signals and/or audio signals, or parts thereof, can be exchanged between the left and right hearing devices. In an embodiment, the first and second hearing devices each comprises antenna and transceiver circuitry configured to allow an exchange of information between them, e.g. status, control and/or audio data. In an embodiment, the first and second hearing devices are configured to allow an exchange of data regarding the direction-of-arrival as estimated in a respective one of the first and second hearing devices to the other one and/or audio signals picked up by input transducers (e.g. microphones) in the respective hearing devices.

The hearing system may comprise a time to time-frequency conversion unit for converting an electric input signal in the time domain into a representation of the electric input signal in the time-frequency domain, providing the electric input signal at each time instance 1 in a number for frequency bins k, k=1, 2, . . . , K.

In an embodiment, the signal processor is configured to provide a maximum-likelihood estimate of the direction of arrival θ of the target sound signal.

In an embodiment, the signal processor(s) is(are) configured to provide a maximum-likelihood estimate of the direction of arrival θ of the target sound signal by finding the value of θ, for which a log likelihood function is maximum, and wherein the expression for the log likelihood function is adapted to allow a calculation of individual values of the log likelihood function for different values of the direction-of-arrival (θ) using a summation over the frequency variable k.

In an embodiment, the likelihood function, e.g. the log likelihood function, is estimated in a limited frequency range $\Delta f_{Like}$, e.g. smaller than a normal frequency range of operation (e.g. 0 to 10 kHz) of the hearing device. In an embodiment, the limited frequency range, $\Delta f_{Like}$, is within the range from 0 to 5 kHz, e.g. within the range from 500 Hz to 4 kHz. In an embodiment, the limited frequency range, $\Delta f_{Like}$, is dependent on the (assumed) accuracy of the relative transfer functions, RFT. RTFs may be less reliable at relatively high frequencies.

In an embodiment, the hearing system comprises one or more weighting units for providing a weighted mixture of said essentially noise-free target signal s(n) provided with appropriate spatial cues, and one or more of said electric input signals or processed versions thereof. In an embodiment, the left and right hearing devices each comprise a weighting unit.

In an embodiment, the hearing system is configured to use a reference microphone located on the left side of the head (θε[0°; 180° ]) for calculations of the likelihood function corresponding to directions on the left side of the head (θε[0°; 180°]).

In an embodiment, the hearing system is configured to use a reference microphone located on the right side of the head (θε[180°; 360° ]) for calculations of the likelihood function corresponding to directions on the right side of the head (θε[180°; 360°]).

In an embodiment, a hearing system comprising left and right hearing devices is provided, wherein at least one of the left and right hearing devices is or comprises a hearing aid, a headset, an earphone, an ear protection device or a combination thereof.

In an embodiment, the hearing system is configured to provide a bias compensation of the maximum-likelihood estimate.

In an embodiment, the hearing system comprises a movement sensor configured to monitor movements of the user's head. In an embodiment, the applied DOA is fixed even though (small) head movements are detected. In the present context, the term 'small' is e.g. taken to mean less than 5°, such as less than 1°. In an embodiment, the movement sensor comprises one or more of an accelerometer, a gyroscope and a magnetometer, which are generally able to detect small movements much faster than the DOA estimator. In an embodiment, the hearing system is configured to amend the applied head related transfer functions (RTFs) in dependence of the (small) head movements detected by the movement sensor.

In an embodiment, the hearing system comprises one or more a hearing devices AND an auxiliary device.

In an embodiment, the auxiliary device comprises a wireless microphone, e.g. a microphone array. In an embodiment the auxiliary device is configured to pick up a target signal, and transmitting an essentially noise-free version of the target signal to the hearing device(s). In an embodiment, the auxiliary device comprises an analog (e.g. FM) radio transmitter, or a digital radio transmitter (e.g. Bluetooth). In an embodiment, the auxiliary device comprises a voice activity detector (e.g. a near-field voice detector), allowing to identify whether a signal picked up by the auxiliary device comprises a target signal, e.g. a human voice (e.g. speech). In an embodiment, the auxiliary device is configured to only transmit in case the signal it picks up comprises a target signal (e.g. speech, e.g. recorded nearby, or with a high signal to noise ratio). This has the advantage that noise is not transmitted to the hearing device.

In an embodiment, the hearing system is adapted to establish a communication link between the hearing device and the auxiliary device to provide that information (e.g. control and status signals, possibly audio signals) can be exchanged or forwarded from one to the other.

In an embodiment, the hearing system is configured to simultaneously receive two or more wirelessly received essentially noise-free target signals from two or more target sound sources via two or more auxiliary devices. In an embodiment, each of the auxiliary devices comprises a wireless microphone (e.g. forming part of another device, e.g. a smartphone) capable of transmitting a respective target sound signal to the hearing system.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is or comprises a smartphone.

In the present context, a SmartPhone, may comprise

- a (A) cellular telephone comprising at least one microphone, a speaker, and a (wireless) interface to the public switched telephone network (PSTN) COMBINED with
- a (B) personal computer comprising a processor, a memory, an operative system (OS), a user interface (e.g. a keyboard and display, e.g. integrated in a touch sensitive display) and a wireless data interface (including a Web-browser), allowing a user to download and execute application programs (APPs) implementing specific functional features (e.g. displaying information retrieved from the Internet, remotely controlling another device, combining information from various sensors of the smartphone (e.g. camera, scanner, GPS, microphone, etc.) and/or external sensors to provide special features, etc.).

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processor for enhancing the input signals and providing a processed output signal.

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound. In an embodiment, the hearing device comprises a directional microphone system adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art.

In an embodiment, the hearing device comprises a beamformer unit and the signal processor is configured to use the estimate of the direction of arrival of the target sound signal relative to the user in the beamformer unit to provide a beamformed signal comprising the target signal.

In an embodiment, the hearing device comprises an antenna and transceiver circuitry for wirelessly receiving a direct electric input signal from another device, e.g. a communication device or another hearing device. In an embodiment, the hearing device comprises a (possibly standardized) electric interface (e.g. in the form of a connector) for receiving a wired direct electric input signal from another device, e.g. a communication device or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by a transmitter and antenna and transceiver circuitry of the hearing device can be of any type. In an embodiment, the wireless link is used under power constraints, e.g. in that the hearing device comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying), e.g. MSK (minimum shift keying), or QAM (quadrature amplitude modulation).

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 70 GHz, e.g. located in a range from 50 MHz to 50 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is a portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer. In an embodiment, the sampling rate of the wirelessly transmitted and/or received version of the target sound signal is smaller than the sampling rate of the electric input signals from the microphones. The wireless signal may e.g. be a television (audio) signal streamed to the hearing device. The wireless signal may be an analog signal, e.g. having a band-limited frequency response.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. the full normal frequency range of operation, or in a part thereof, e.g. in a number of frequency bands, e.g. in the lowest frequency bands or in the highest frequency bands.

In an embodiment, the number of detectors comprises a level detector for estimating a current level of a signal of the forward path. In an embodiment, the predefined criterion comprises whether the current level of a signal of the forward path is above or below a given (L-)threshold value.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing device comprises a movement detector, e.g. a gyroscope or an accelerometer.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic;
b) the current acoustic situation (input level, feedback, etc.), and
c) the current mode or state of the user (movement, temperature, etc.);
d) the current mode or state of the hearing device (program selected, time elapsed since last user interaction, etc.) and/or of another device in communication with the hearing device.

In an embodiment, the hearing device comprises an acoustic (and/or mechanical) feedback suppression system.

In an embodiment, the hearing device further comprises other relevant functionality for the application in question, e.g. compression, noise reduction, etc.

In an embodiment, the hearing device comprises a hearable, such as a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing system as described above, in the 'detailed description of embodiments' and in the claims, is moreover provided. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

In an embodiment, use of a hearing system to apply spatial cues to a wirelessly received essentially noise-free target signal from a target sound source is provided.

In an embodiment, use of a hearing system in a multi-target sound source situation to apply spatial cues to two or more wirelessly received essentially noise-free target signals from two or more target sound sources. In an embodiment, the target signal(s) is(are) picked up by a wireless microphone (e.g. forming part of another device, e.g. a smartphone) and transmitted to the hearing system.

A method:

In an aspect, a method of operating a hearing system comprising left and right hearing devices adapted to be worn at left and right ears of a user is furthermore provided by the present application. The method comprises providing M electric input signals $r_m(n)$, m=1, . . . , M, where M is larger than or equal to two, n representing time, said M electric input signals representing environment sound at a given microphone location and comprising a mixture of a target sound signal propagated via an acoustic propagation channel from a location of a target sound source and possible additive noise signals $v_m(n)$ as present at the location of the microphone location in question;

receiving a wirelessly transmitted version of the target sound signal and providing an essentially noise-free target signal s(n);

processing said M electric input signals said essentially noise-free target signal;

estimating a direction-of-arrival of the target sound signal relative to the user based on a signal model for a received sound signal $r_m$ at microphone m (m=1, . . . , M) through the acoustic propagation channel from the target sound source to the $m^{th}$ microphone when worn by the user, wherein the $m^{th}$ acoustic propagation channel subjects the essentially noise-free target signal s(n) to an attenuation $\alpha_m$ and a delay $D_m$;

a maximum likelihood methodology;

relative transfer functions dm representing direction-dependent filtering effects of the head and torso of the user in the form of direction-dependent acoustic transfer functions from each of M−1 of said M microphones (m=1, . . . , M, m≠j) to a reference microphone (m=j) among said M microphones.

The estimate of the direction-of-arrival is performed under the constraints that said attenuation $\alpha_m$ is assumed to be independent of frequency whereas said delay $D_m$ may be frequency dependent.

It is intended that some or all of the structural features of the system described above, in the 'detailed description of embodiments' or in the claims can be combined with embodiments of the method, when appropriately substituted by a corresponding process and vice versa. Embodiments of the method have the same advantages as the corresponding system.

In an embodiment, the relative transfer functions $d_m$ are pre-defined (e.g. measured on a model or on the user, and stored in a memory. In an embodiment, the delay $D_m$ is frequency dependent.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as binaural hearing systems, e.g. binaural hearing aids systems.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
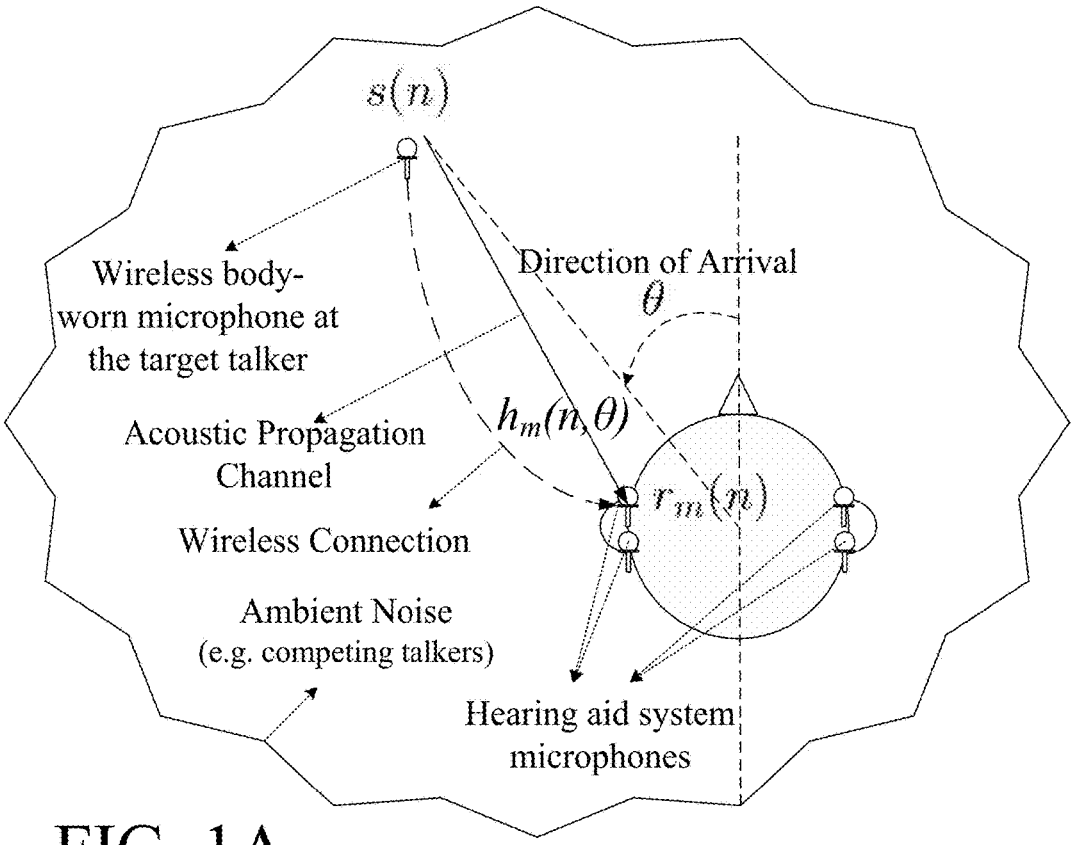
FIG. 1A shows an "informed" binaural direction of arrival (DoA) estimation scenario for a hearing aid system using a wireless microphone, wherein $r_m(n)$, s(n) and $h_m(n, \theta)$ are the noisy received sound at microphone m, the (essentially) noise-free target sound from a target sound source S, and the acoustic channel impulse response between the target sound source S and microphone m, respectively, and FIG. 1B schematically illustrates a geometrical arrangement of sound source S relative to a hearing aid system according to an embodiment of the present disclosure comprising first and second hearing devices $HD_L$ and $HD_R$ located at or in first (left) and second (right) ears, respectively, of a user, FIG. 2A schematically illustrates an example of the location of a reference microphone for the evaluation of the maximum likelihood function L for $\theta\varepsilon[-90°; 0°]$, and FIG. 2B schematically illustrates an example of the location of the reference microphone for the evaluation of the maximum likelihood function L for $\theta\varepsilon[0°, +90°]$.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to hearing devices, e.g. hearing aids, in particular to the field of sound source localization.

The auditory scene analysis (ASA) ability in human beings allows us to focus intentionally on a sound source, while suppressing other (unrelated) sound sources, which may be present simultaneously in realistic acoustic scenes. Sensorineural hearing-impaired listeners lose this ability to some extent and face difficulties in interacting with the environment. In an attempt to retrieve the normal interactions of the hearing impaired users with the environment, hearing aid systems (HASs) may carry out some of the ASA tasks, which are carried out by the healthy auditory system.

The present disclosure deals with sound source localization (SSL)-one of the main tasks in ASA—in a hearing aid context. SSL using microphone arrays has been investigated extensively in various applications, such as robotics, video conferencing, surveillance, and hearing aids (see e.g. [12]-[14] in [1]). In most of these applications, the noise-free content of the target sound is not accessible. However, recent HASs can connect to a wireless microphone worn by the target talker to access an essentially noise-free version of the target signal emitted at the target talker's position (see e.g. ref. [15]-[21] in [1]). This new feature introduces the "informed" SSL problem considered in the present disclosure.

FIG. 1A shows an "informed" binaural direction of arrival (DoA) estimation scenario for a hearing aid system using a wireless microphone, wherein $r_m(n)$, s(n) and $h_m(n, \theta)$ are the noisy received sound at microphone m, the (essentially) noise-free target sound from a target sound source S, and the acoustic channel impulse response between the target sound source S and microphone m, respectively.

FIG. 1A illustrates a relevant scenario. A speech signal s(n) (a target signal, n being a time index) generated by target signal source S, e.g. a target talker and picked up by a microphone at the talker (cf. Wireless body-worn microphone at the target talker) is transmitted through an acoustic propagation channel $h_m(n, \theta)$ (transfer function (impulse response) of the Acoustic Propagation Channel indicated by a solid arrow) and reaches microphone m (m=1, 2, 3, 4)) of a hearing system (cf. Hearing aid system microphones). The M=4 microphones are distributed with two microphones at each of left, and right hearing devices, respectively, e.g. comprising first and second a hearing aids located at left and right ears of a user (indicated by symbolic top view of a head with ears and nose, see also FIG. 1B). Due to (potential) additive environmental noise (cf. Ambient Noise (e.g. competing talkers)), a noisy signal $r_m(n)$ (comprising the target signal and environmental noise) is received at microphone m (here a ('front facing') microphone of a hearing device located at the left ear of the user, cf. also 'front microphone' $FM_L$ in FIG. 1B). The essentially noise-free target signal s(n) is transmitted to the hearing device via a wireless connection (cf. dashed arrow denoted Wireless Connection) (the term 'essentially noise-free target signal s(n)' indicates the assumption that s(n)—at least typically—comprises less noise than the signal $r_m(n)$ received by the microphones at the user). An aim of the present disclosure is to estimate the direction of arrival (DoA) (cf. Direction of Arrival) of the target signal relative to the user using these signals (cf. angle θ relative to a direction defined by dashed line through the tip of the user's nose). The direction of arrival is (for simplicity) indicated in FIGS. 1A and B (and throughout the present disclosure) as an angle θ in a horizontal plane, e.g. through the ears of the user (e.g. including the 4 microphones of the left and right hearing aids). The direction of arrival may, however, be represented by direction that is not located in a horizontal plane and thus characterized by more than one coordinate (e.g. an azimuthal angle φ in addition to θ). It is considered to be within the capability of the skilled person to modify the disclosed scheme correspondingly.

Figure 1B:
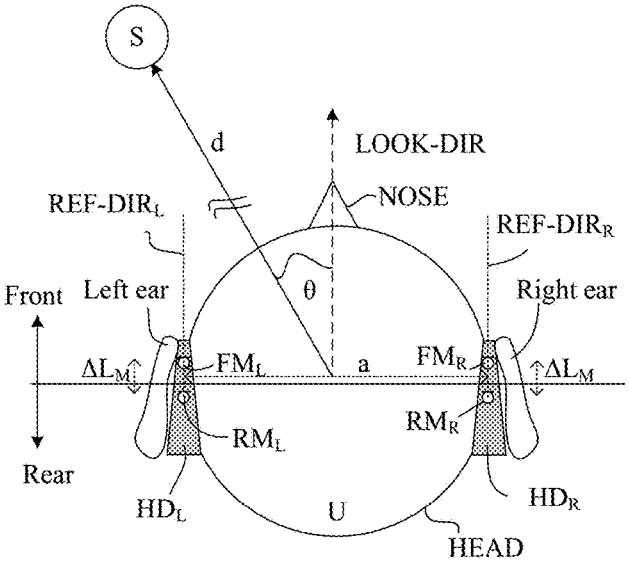

FIG. 1B schematically illustrates a geometrical arrangement of a sound source S relative to a hearing aid system comprising left and right hearing devices ($HD_L$, $HD_R$) when located on the head (HEAD) at or in left (Left ear) and right (Right ear) ears, respectively, of a user (U).

The setup is similar to the one described above in connection with FIG. 1A. Front and rear directions and front and rear half planes of space (cf. arrows Front and Rear) are defined relative to the user (U) and determined by the look direction (LOOK-DIR, dashed arrow) of the user (defined by the user's nose (NOSE)) and a (vertical) reference plane through the user's ears (solid line perpendicular to the look direction (LOOK-DIR)). The left and right hearing devices ($HD_L$, $HD_R$) each comprise a BTE-part located at or behind-the-ear (BTE) of the user. In the example of FIG. 1B, each BTE-part comprises two microphones, a front-located microphone ($FM_L$, $FM_R$) and a rear-located microphone ($RM_L$, $RM_R$) of the left and right hearing devices, respectively. The front and rear microphones on each BTE-part are spaced a distance $\Delta L_M$ apart along a line (substantially) parallel to the look direction (LOOK-DIR), see dotted lines $REF\text{-}DIR_L$ and $REF\text{-}DIR_R$, respectively. As in FIG. 1A, a target sound source S is located at a distance d from the user and having a direction-of-arrival defined (in a horizontal plane) by angle θ relative to a reference direction, here a look direction (LOOK-DIR) of the user. In an embodiment, the user U is located in the acoustic far field of the sound source S (as indicated by broken solid line d). The two sets of microphones ($FM_L$, $RM_L$), ($FM_R$, $RM_R$) are spaced a distance a apart. In an embodiment, the distance a is an average distance between the two sets of microphones (¼)(a($FM_L$, $FM_R$)+a($RM_L$, $RM_R$)+($FM_L$, $RM_R$)+($RM_L$, $FM_R$)), where a($FM_L$, $FM_R$), for example, indicates the distance between the front microphones (FM) of the left (L) and right (R) hearing devices. In an embodiment, for a system comprising a single hearing device (or independent hearing devices of a system), the model parameter $\alpha$ represents the distance between a reference microphone and other microphones within each hearing device ($HD_L$, $HD_R$).

Estimation of the target sound DoA allows the HAs to enhance the spatial rendering of the acoustic scene presented to the user, e.g. by imposing the corresponding binaural cues on the wirelessly received target sound (ref. [16], [17] in [1]). The "informed" SSL problem for hearing aid applications was first studied in ref. [15] in [1]. The method proposed in ref. [15] in [1] is based on estimation of time difference of arrivals (TDoAs), but it does not take the shadowing effect of the user's head and potential ambient noise characteristics into account. This degrades the DoA estimation performance markedly. To consider the head shadowing effect and ambient noise characteristics for the "informed" SSL, a maximum likelihood (ML) approach has been proposed in ref. [18] in [1] using a database of measured head related transfer functions (HRTFs). To estimate the DoA, this approach, called MLSSL (maximum likelihood sound source localization), looks for the HRTF entry in the database, which maximizes the likelihood of the observed microphone signals. MLSSL has relatively high computational load, but it performs effectively under severely noisy conditions, when the detailed individualized HRTFs for different directions and different distances are available ref. [18], [21] in [1]. On the other hand, when the individualized HRTFs are not available, or when the HRTFs corresponding to the actual distance of the target are not in the database, the estimation performance of MLSSL degrades dramatically. In ref. [21] in [1], a new ML approach, which also considers head shadowing effects and ambient noise characteristics, has been proposed for "informed" SSL using a database of measured relative transfer functions (RTFs). Measured RTFs can easily be obtained from the measured HRTFs. Compared with MLSSL, the approach of ref. [21] in [1] has lower computational load, and provides more robust performance, when an individualized database is not available. RTFs, in comparison with HRTFs, are almost independent of the distance between the target talker and the user, especially in far-field situations. Typically, an external microphone will be placed in the acoustic far-field with respect to a hearing device (cf. e.g. scenarios of FIG. 5-8). The distance independency of RTFs reduces the required memory and the computational load of the estimator proposed in ref. [21] in [1] compared with MLSSL. This is because to estimate the DoA, the proposed estimator in ref. [21] in [1] must search in an RTF database, which is only a function of DoA, while MLSSL must search in an HRTF database which is a function of both DoA and distance.

In the present disclosure, an ML approach is proposed that uses a database of measured RTFs to estimate the DoA. Unlike the estimator proposed in ref. [21] in [1], which considers a binaural configuration using two microphones (one microphone in each HA), the proposed method generally works for any number of microphones M≥2, in monaural as well as binaural configurations. Further, compared with ref. [21] in [1], the proposed method decreases the computational load and the wireless communications between the HAs, while maintaining—and even improving—the estimation accuracy. To decrease the computational load, we relax some of the constraints used in ref. [21] in [1]. This relaxation makes the signal model more realistic, and we show that it also allows us to formulate the problem in a way that decreases the computational load. To decrease the wireless communications between the HAs for the DoA estimation, we propose an information fusion strategy, which allows us to transmit some probabilities between the HAs instead of whole signal frames. Finally, we analytically investigate the bias in the estimator, and propose a closed-form bias-compensation strategy, resulting in an unbiased estimator.

In the following, equation numbers '(p)' correspond to the outline in [1].

Signal Model:

Generally, we assume a signal model of the form describing the noisy signal $r_m$ received by the $m^{th}$ input transducer (e.g. microphone m):

$$r_m(n)=s(n)*h_m(n,\theta)+v_m(n),(m=1,2,\ldots,M). \tag{1}$$

where s(n) is the (essentially) noise-free target signal emitted at the position of the target sound source (e.g. a talker), $h_m(n,\theta)$ is the acoustic channel impulse response between the target sound source and microphone m, and $v_m(n)$ is an additive noise component. θ is the angle (or position) of the direction-of-arrival of the target sound source relative to a reference direction defined by the user (and/or by the location of the left and right hearing devices on the body (e.g. the head, e.g. at the ears) of the user). Further, n is a discrete time index, and * is the convolution operator. In an embodiment, a reference direction is defined by a look direction of the user (e.g. defined by the direction that the user's nose points in (when seen as an arrow tip), cf. e.g. FIG. 1A, 1B).

In an embodiment, the short-time Fourier transform domain (STFT) is used, which allows all involved quantities to be expressed as functions of a frequency index k, a time (frame) index l, and the direction-of-arrival (angle) θ. The use of the STFT domain allows frequency dependent processing, computational efficiency and the ability to adapt to the changing conditions, including low latency algorithm implementations. In the STFT domain, eq. (1) can be approximated as $$R_m(l,k)=S(l,k)H_m(k,\theta)+V_m(l,k) \tag{2}$$

where $$R_m(l,k)=\sum_n r_m(n)w(n-lA)e^{-\frac{j2\pi k}{N}(n-lA)}$$

denotes the STFT of $r_m(n)$, m=1, . . . , M, l and k are frame and frequency bin indexes, respectively, N is the discrete Fourier transform (DFT) order, A is a decimation factor, w(n) is the windowing function, and $j=\sqrt{(-1)}$ is the imaginary unit (not to be confused with the reference microphone index j used elsewhere in the disclosure). S(l,k) and $V_m(l,k)$ denote the STFT of s(n) and $v_m(n)$, respectively, and are defined analogously to $R_m(l,k)$. Moreover, $$\begin{aligned} H_m(k,\theta) &= \Sigma_n h_m(n,\theta)e^{-\frac{j2\pi kn}{N}}, \\ &= \alpha_m(k,\theta)e^{-\frac{j2\pi k}{N}D_m(k,\theta)}, \end{aligned} \tag{3}$$

denotes the Discrete Fourier Transform (DFT) of the acoustic channel impulse response $h_m(n, \theta)$, where N is the DFT order, $\alpha_m(k, \theta)$ is a positive real number and denotes the frequency-dependent attenuation factor due to propagation effects, and $D_m(k, \theta)$ is the frequency-dependent propagation time from the target sound source to microphone m.

Eq. (2) is an approximation of eq. (1) in the STFT domain. This approximation is known as the multiplicative transfer function (MTF) approximation, and its accuracy depends on the length and smoothness of the windowing function w(n): the longer and the smoother the analysis window w(n), the more accurate the approximation.

Let $d(k, \theta)=[d_1(k, \theta), d_2(k, \theta), \ldots, d_M(k, \theta)]^T$ denote a vector of RTFs defined w.r.t a reference microphone, as $$d_m(k, \theta) = \frac{H_m(k, \theta)}{H_j(k, \theta)} \quad m = 1, \ldots, M, \tag{4}$$

where j is the index of the reference microphone. Moreover, let $$R(l,k)=[R_1(l,k),R_2(l,k), \ldots ,R_M(l,k)]^T; \text{ and}$$

$$V(l,k)=[V_1(l,k),V_2(l,k), \ldots ,V_M(l,k)]^T.$$

Now, we can rewrite the Eq. (2) into a vector form as:

$$R(l,k)=S(l,k)H_j(k,\theta)d(k,\theta)+V(l,k). \tag{5}$$

Maximum Likelihood Framework:

The general goal is to estimate the direction-of-arrival θ using a maximum likelihood framework. To define the likelihood function, we assume the additive noise V(l,k) is distributed according to a zero-mean circularly-symmetric complex Gaussian distribution:

$$V(l, k) = \begin{bmatrix} V_{left} \\ V_{right} \end{bmatrix} \sim \mathbb{N}(0, C_v(l, k)),$$

Where $\mathbb{N}$ indicates multivariate normal distribution, $C_v(l,k)$ is the noise cross power spectral density (CPSD) matrix defined as $C_v(l,k)=E\{V(l,k)V^H(l,k)\}$, where $E\{\cdot\}$ and superscript $^H$ represent the expectation and Hermitian transpose operators, respectively. The additive noise component V(l,k) may e.g. be estimated by a $1^{st}$ order IIR filter. In an embodiment, the time constant of the IIR filter is adaptive, e.g. depending on a head movement, e.g. update estimate (time constant small), when a head movement is detected). It may be assumed that the target signal is picked up without any noise by the wireless microphone, in which case we can consider S(l; k) as a deterministic and known variable. Moreover, $H_j(k; \theta)$ and $d(k; \theta)$ can also be considered deterministic, but unknown. Further, $C_v(l,k)$ can be assumed to be known. Hence from eq. (5) it follows that $$R(l,k) \sim \mathbb{N}(S(l,k)H_j(k,\theta)d(k,\theta),C_v(l,k)). \tag{6}$$

Further, it is assumed that the noisy observations are independent across frequencies (strictly speaking, this assumption is valid when the correlation time of the signal is short compared with the frame length). Therefore, the likelihood function for frame l is defined by equation (7) below:

$$p(\underline{R}(l); H_j(\theta), \underline{d}(\theta)) = \prod_{k=0}^{N-1} \frac{1}{\pi^M |C_v(l, k)|} e^{\{-(Z(l,k))^H C_v^{-1}(l,k)(Z(l,k))\}} \tag{7}$$

where |·| denotes the matrix determinant, N is the DFT order, and $$\underline{R}(l)=[R(l,0),R(l,1), \ldots ,R(l,N-1)],$$

$$H_j(\theta)=[H_j(0,\theta),H_j(1,\theta), \ldots ,H_j(N-1,\theta)]$$

$$d(\theta)=[d(0,\theta),d(1,\theta), \ldots ,d(N-1,\theta)]$$

$$Z(l,k)=R(l,k)-S(l,k)H_j(k,\theta)d(k,\theta).$$

To reduce the computational overhead, we consider the log-likelihood function and omit the terms independent of θ. The corresponding (reduced) log-likelihood function L is given by:

$$\mathcal{L}(\underline{R}(l); H_j(\theta), \underline{d}(\theta)) = \sum_{k=0}^{N-1} \{-(Z(l, k))^H C_v^{-1}(l, k)(Z(l, k))\} \tag{8}$$

The ML estimate of θ is found by maximizing log-likelihood function L with respect to θ.

The Proposed DOA Estimator:

To derive the proposed estimator, we assume a database Θ of pre-measured d's labeled by their corresponding $\theta_i$ is available. To be more precise, $\Theta=\{\underline{d}(\theta_1), \underline{d}(\theta_2), \ldots, \underline{d}(\theta_I))\}$ (where I is the number of entries in Θ) is assumed to be available for the DoA estimation. To find the ML estimate of θ, the proposed DoA estimator evaluates L for each $\underline{d}(\theta_i)\varepsilon\Theta$. The MLE of θ is the DoA label of the $\underline{d}$, which results in the highest log-likelihood. In other words, $$\hat{\theta}=\arg\max_{\underline{d}(\theta_i)\in\Theta} \mathcal{L}(\underline{R}(l);H_j(\theta),\underline{d}(\theta_i)) \tag{9}$$

To solve the problem and to exploit the accessible S(l; k) in the DoA estimator, it is assumed that $H_j$ is related to a "sunny" microphone, and it is assumed that the attenuation $\alpha_j$ is frequency independent. The "sunny" microphone, when L is evaluated for $\underline{d}(\theta_i)\varepsilon\theta$, is the microphone which is not in the shadow of the head, if we consider the sound is coming from the $\theta_i$ direction.

In other words, when the method evaluates L for $\underline{d}$s corresponding to directions to the left side of the head, $H_j$ is related to a microphone in the left hearing aid, and when the method evaluates L for $\underline{d}$s corresponding to directions to the right side of the head, $H_j$ is related to a microphone in the right hearing aid. Note that this evaluation strategy requires no prior knowledge about the true DoA.

In contrast to the method proposed in our co-pending European patent application EP16182987.4 ([4]), the frequency-independency constraint on the delay $D_j$ is removed.

Removing this constraint makes the signal model more realistic. Moreover, for evaluating L, we will show that it allows us to simply sum over all frequency bins instead of computing an IDFT. This decreases the computational load of the estimator because an IDFT requires at least N log N operations, while summing over all frequency bins components needs only N operations.

An expression for the log likelihood function L is provided in eq. (18)

$$\mathcal{L}(\underline{R}(l); \underline{d}(\theta)) = \frac{\left(\sum_{k=0}^{N-1} |S^*(l, k)d^H(k, \theta)C_v^{-1}(l, k)R(l, k)|\right)^2}{\sum_{k=0}^{N-1} |S(l, k)|^2 d^H(k, \theta)C_v^{-1}(l, k)d(k, \theta)} \tag{18}$$

which only depends on the unknown $\underline{d}(\theta)$. Note that the available clean target signal S(l,k) also contributes in the derived log-likelihood function. The MLE of θ can be expressed as $$\hat{\theta}=\arg\max_{\underline{d}(\theta_i)\in\Theta}\mathcal{L}(\underline{R}(l);\underline{d}(\theta_i)) \tag{19}$$

Bias Compensated Estimator.

At very low SNRs, i.e., situations where there is essentially no evidence of the target direction, it is desirable that the proposed estimator (or any other estimator for that matter) does not systematically pick one direction—in other words, it is desirable that the resulting DOA estimates are distributed uniformly in space. A modified (bias-compensated) estimator as proposed in the present disclosure (and defined in eq. (29)-(30) below) results in DOA estimates that are uniformly distributed in space.

$$\mathcal{L}(\underline{R}(l);\ \underline{d}(\theta)) = \frac{\left(\sum_{k=0}^{N-1}|S^*(l,k)d^H(k,\theta)C_v^{-1}(l,k)R(l,k)|\right)^2}{\sum_{k=0}^{N-1}|S^*(l,k)|^2 d^H(k,\theta)C_v^{-1}(l,k)d(k,\theta)} - \frac{\left(\sum_{k=0}^{N-1}\sqrt{\frac{\pi}{4}|S(l,k)|^2 d^H(k,\theta)C_v^{-1}(l,k)d(l,k)}\right)^2}{\sum_{k=0}^{N-1}|S(l,k)|^2 d^H(k,\theta)C_v^{-1}(l,k)d(k,\theta)} - \frac{4-\pi}{4} \tag{29}$$

and the bias-compensated MLE of θ is given by $$\hat{\theta}=\arg\max_{\underline{d}(\theta_i)\in\Theta}\mathcal{L}(\underline{R}(l);\underline{d}(\theta_i)) \tag{30}$$

In an embodiment, a prior (e.g. probability p vs. angle θ) is implemented as posterior $\propto\mathcal{L}(\underline{R}(l);\underline{d}(\theta))\cdot$prior:

$$\hat{\theta}=\operatorname{argmax}_{\underline{d}(\theta_i)\in\Theta}\exp(\mathcal{L}\underline{R}(l);\underline{d}(\theta_i))p(\theta)$$

Reducing Binaural Information Exchange.

The proposed bias-compensated DoA estimator generally decreases the computational load compared to other estimators, e.g. [4]. In the following, a scheme for decreasing the wireless communication overhead between hearing aids (HA) of a binaural hearing aid system comprising four microphones (two microphones in each HA) is proposed.

In general, it has been assumed that the signals received by all microphones of the hearing aid system are available at the "master" hearing aid (the hearing aid which performs the DoA estimation) or dedicated processing device. This means that one of the hearing aids should transmit the signals received by its microphones to the other hearing aid (the "master" HA).

The trivial way to completely eliminate the wireless communications between HAs is that each HA estimates the DoA independently using the signals received by its own microphones. In this way, there is no need to transmit the signals between the HAs. However, this way is expected to degrade the estimation performance notably because the number of observations (signal frames) has been decreased.

In contrast to the trivial way described above, an information fusion (IF) strategy which does not need to transmit all full audio signals between the HAs to improve the estimation performance is proposed in the following.

It is assumed that each HA evaluates L locally for each $\underline{d}(\theta_1)\varepsilon\Theta$, using the signals picked up by its own microphones. This means for each $\underline{d}(\theta_i)\varepsilon\Sigma$, we will have two evaluations of L relating to the left and the right HA (denoted $L_{left}$ and $L_{right}$, respectively). Afterwards, one of the HAs, e.g. the right HA, transmits the evaluation values of $L_{right}$ for all $\underline{d}(\theta_i)\varepsilon\Theta$ to the "master" HA, i.e. the (here) left HA. To estimate the DoA, the "master" HA uses an IF technique, as defined below, to combine $L_{left}$ and $L_{right}$ values. This strategy decreases the wireless communication between the HAs, because instead of transmitting all the signals, it only needs to transmit I different evaluations of L corresponding to different $\underline{d}(\theta_i)\varepsilon\Theta$, at each time frame. This has the advantage of providing the same DoA decision at both hearing devices.

In the following, we describe an IF technique to fuse $L_{left}$ and $L_{right}$ values. The main idea is to estimate $P(\underline{R}_{left}(l), \underline{R}_{right}(l);\ \underline{d}(\theta_i))$, where $\underline{R}_{left}(l)$ and $\underline{R}_{right}(l)$, respectively, represent the signals received by the microphones of the left HA and the right HA, using the following conditional probabilities: $\mathcal{L}$ $$p(\underline{R}_{left}(l);\underline{d}(\theta_i))\propto\exp(\mathcal{L}_{left}(\underline{R}_{left}(l);\underline{d}(\theta_i)) \tag{31}$$

$$p(\underline{R}_{right}(l);\underline{d}(\theta_i))\propto\exp(\mathcal{L}_{right}(\underline{R}_{right}(l);\underline{d}(\theta_i)) \tag{32}$$

or correspondingly, if a prior probability $p(\theta_i)$ is assumed:

$$p(\underline{R}_{left}(l);\underline{d}(\theta_i))\propto\exp(\mathcal{L}_{left}(\underline{R}_{left}(l);\underline{d}(\theta_i)) \tag{31'}$$

$$p(\underline{R}_{right}(l);\underline{d}(\theta_i))\propto\exp(\mathcal{L}_{right}(\underline{R}_{right}(l);\underline{d}(\theta_i)) \tag{32'}$$

In general, to calculate $p(\underline{R}_{left}(l), \underline{R}_{right}(l);\ \underline{d}(\theta_i))$, the covariance between $\underline{R}_{left}(l)$ and $\underline{R}_{right}(l)$ must be known; and to estimate this covariance matrix, the microphones' signals must be transmitted between the HAs. However, if we assume $\underline{R}_{right}(l)$ and $\underline{R}_{left}(l)$ are conditionally independent of each other given $\underline{d}(\theta_i)$, there is no need to transfer the signals between the HAs, and we will simply have $$P(\underline{R}_{left}(l),\underline{R}_{right}(l);d(\theta_i))=p(\underline{R}_{left}(l);\vec{d}(\theta_i))\times p(\underline{R}_{right}(l);\underline{d}(\theta_i)) \tag{33}$$

Thereby the estimation of θ is also given by $$\hat{\theta}=\operatorname{argmax}_{\underline{d}(\theta_i)\in\Theta}p(\underline{R}_{left}(l),\underline{R}_{right}(l);\underline{d}(\theta_i)) \tag{34}$$

Figure 2A:
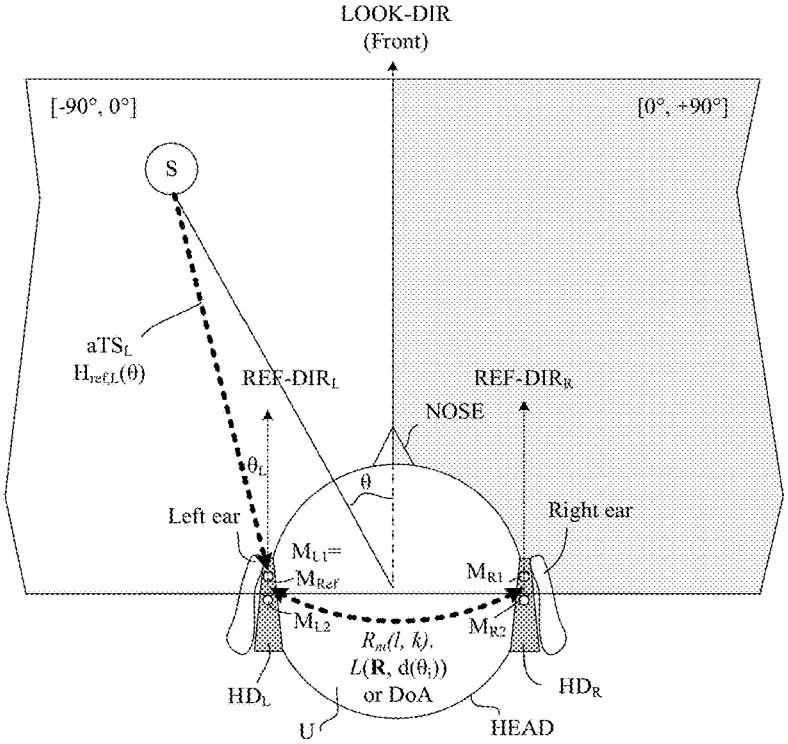
Figure 2B:
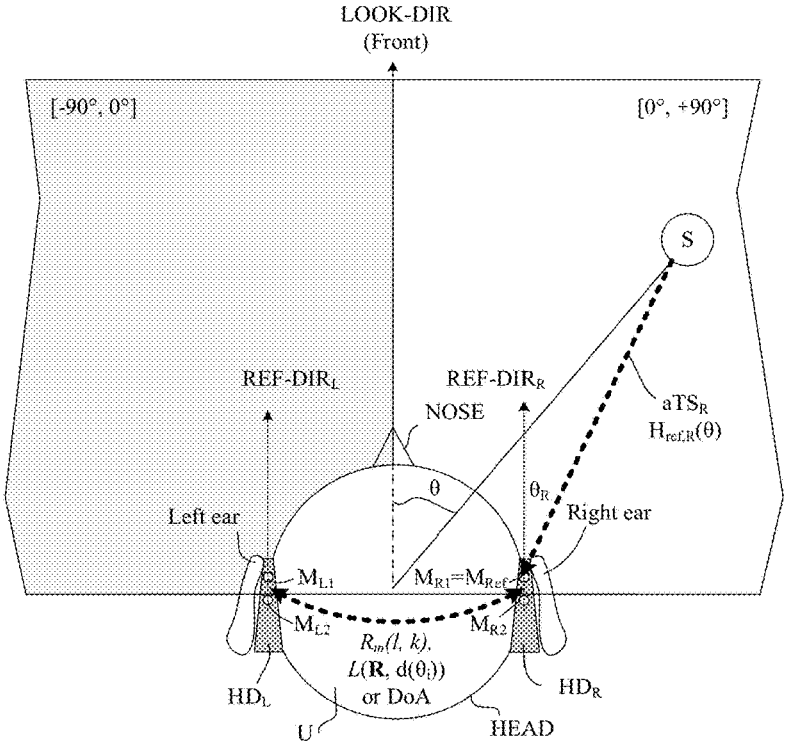

FIGS. 2A and 2B schematically illustrates examples of the location of a reference microphone for the evaluation of the maximum likelihood function L for θε[−90°; 0° ], and for θε[0°, +90° ], respectively. The setup is similar to that of FIG. 1B showing a hearing system, e.g. a binaural hearing aid system, comprising left and right hearing devices ($HD_L$, $HD_R$) each comprising two microphones ($M_{L1}$, $M_{L2}$) and ($M_{R1}$, $M_{R2}$), respectively. A target sound source (S) is located in the left (θε[−90°; 0°]) and right (θε[0°, +90° ]) front quarter plane, in FIGS. 1A and 2B, respectively, 'front' being defined relative to the user's look direction (cf. (Front), LOOK-DIR, Nose in FIG. 2A, 2B). In the situation of FIG. 2A, the reference microphone ($M_{Ref}$) is taken to be $M_{L1}$, whereas in the situation of FIG. 2B, the reference microphone ($M_{Ref}$) is taken to be $M_{R1}$. Thereby the reference microphone ($M_{Ref}$) is not in the shadow of the user's (U) head (HEAD). An acoustically propagated version $aTS_L$ and $aTS_R$ of the target signal from target sound source (S) to the reference microphone ($M_{Ref}$) of the left and right hearing device ($HD_L$, $HD_R$), respectively, is shown in FIGS. 2A and 2B, respectively. A specific acoustic transfer function $H_{ref}(k, \theta)$ (cf. $H_j(k, \theta)$ in eq. (4) above) from the target sound source (S) to the reference microphone ($M_{Ref}$) is thus defined in each of FIGS. 2A and 2B (cf. $H_{ref,L}(k, \theta)$ and $H_{ref,R}(k, \theta)$, respectively). In an embodiment, each of the acoustic transfer functions ($H_{ref,L}(k, \theta)$ and $H_{ref,R}(k, \theta)$) are accessible to the hearing system (e.g. stored in a memory). Alternatively, a multiplication factor for converting relative transfer functions from one reference microphone to another is accessible (e.g. stored). Thereby only one set of relative transfer functions $d_m(k, \theta)$ (cf. eq. (4)) need to be available (e.g. stored).

In the scenario of FIG. 2A, 2B, the hearing system is configured to exchange data between the left and right hearing devices (e.g. hearing aids) ($HD_L$, $HD_R$). In an embodiment, the data exchanged between the left and right hearing devices include the noisy microphone signals $R_m(l, k)$ picked up by the microphones of the respective hearing devices (i.e. in the example of FIG. 2A, 2B, time and frequency dependent noisy input signals $R_{1L}$, $R_{2L}$ and $R_{1R}$, $R_{2R}$, respectively), l and k being time frame and frequency band indices, respectively. In an embodiment, only some of the noisy input signals, e.g. from the front microphones are exchanged. In an embodiment, only a selected frequency range, e.g. selected frequency bands, e.g. lower frequency bands (e.g. below 4 kHz), of the noisy input signals (and or the likelihood functions) are exchanged. In an embodiment, the noisy input signals are only exchanged with a decimated frequency, e.g. every second or less. In another embodiment, only likelihood values ($L(R, d(\theta_i))$), e.g. log likelihood values) for a number of direction of arrivals DoA ($\theta$), e.g. qualified to a limited (realistic) angular range $\theta_1$-$\theta_2$, e.g. $\theta\varepsilon[-90°; 90°]$ are exchanged between the left and right hearing devices ($HD_L$, $HD_R$). In an embodiment, the log-likelihood values are summed to 4 kHz. In an embodiment, exponential smoothing technique is used to average the likelihood values over time with a time constant of 40 milliseconds. In an embodiment, the sampling frequency is 48 kHz, with a window length of 2048 samples. In an embodiment, the angular range of expected direction of arrivals DoA ($\theta$) is divided into a number I of separate values of $\theta$, ($\theta_i$, i=1, 2, . . . , I) for which the relative transfer functions are available and for which the likelihood function L, and thus for which an estimate $\hat{\theta}$ of DoA, can be determined. In an embodiment, the number of separate values I is ≤180, e.g. ≤90, such as ≤30. In an embodiment, the distribution of separate values of $\theta$, is uniform (over the expected angular range, e.g. with an angular step of 10° or less, such as ≤5°). In an embodiment, the distribution of separate values of $\theta$, is non-uniform, e.g. denser in an angular range close to a user's look-direction and less dense outside this range (e.g. behind the user (if e.g. microphones are located at both ears), and/or to one or both sides of the user (if e.g. microphones are located at one ear).

Figure 3A:
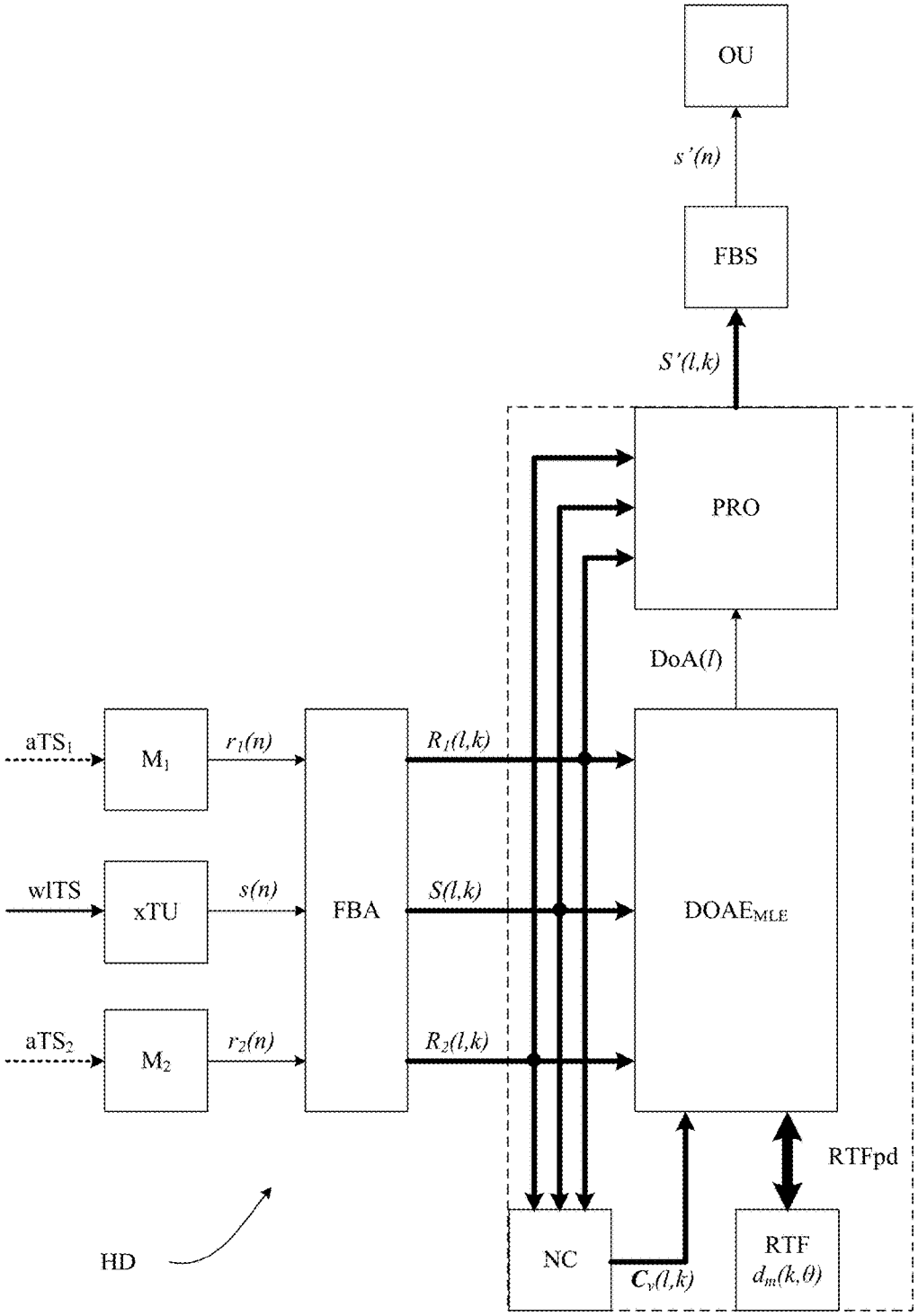
FIG. 3A shows a hearing device comprising a direction of arrival estimator according to an embodiment of the present disclosure.

FIG. 3A shows a hearing device (HD) comprising a direction of arrival estimator according to an embodiment of the present disclosure. The hearing device (HD) comprises first and second microphones ($M_1$, $M_2$) for picking up sounds $aTS_1$ and $aTS_2$, respectively, from the environment, and to provide corresponding electric input signals $r_m(n)$, m=1, 2, n representing time. The environment sound ($aTS_1$ and $aTS_2$) at a given microphone ($M_1$ and $M_2$, respectively) comprises a mixture of a target sound signal s(n) propagated via an acoustic propagation channel from a location of a target sound source (S) and possible additive noise signals $v_m(n)$ as present at the location of the microphone in question. The hearing device further comprises transceiver unit (xTU) for receiving electromagnetic signal wITS comprising an essentially noise-free (clean) version of the target signal s(n) from the target signal source (S). The hearing device (HD) further comprises a signal processor (SPU) connected to the microphones ($M_1$, $M_2$) and to said wireless transceiver (xTU) (cf. dashed outline in FIG. 3A). The signal processor (SPU) is configured to estimate a direction-of-arrival DoA of the target sound signal s relative to the user based on a signal model for a received sound signal $r_m$ at microphone m (m=1, 2) through the acoustic propagation channel from the target sound source (S) to the $m^{th}$ microphone when worn by the user, wherein the $m^{th}$ acoustic propagation channel subjects the essentially noise-free target signal s(n) to an attenuation $\alpha_m$ and a delay $D_m$. The signal processor is configured to use a maximum likelihood methodology to estimate the direction-of-arrival DoA of the target sound signal s based on the noisy microphone signals $r_1(n)$, $r_2(n)$, the essentially noise-free target signal s(n) and (predetermined) relative transfer functions $d_m$ representing direction-dependent filtering effects of the head and torso of the user in the form of direction-dependent acoustic transfer functions from each of M−1 of said M microphones (m=1, . . . , M, m≠j) to a reference microphone (m=j) among the M microphones. In the example of FIG. 3A, M=2, one of the two microphones being a reference microphone. In this case, only one relative (frequency and location (e.g. angle) dependent) transfer function needs to be determined (and stored on a medium accessible to the signal processor) in advance of use of the hearing device. In the embodiment of FIG. 3A, the appropriate predefined relative transfer functions $d_m(k, \theta)$, m=1, 2, are stored in memory unit RTF, here forming part of the signal processor. In the present disclosure, it is assumed that the attenuation $\alpha_m$ of the $m^{th}$ acoustic propagation channel is independent of frequency, whereas the delay $D_m$ is or may be frequency dependent.

The hearing device, e.g. the signal processor (SPU), comprises appropriate time to time-frequency conversion units (here analysis filter banks FBA) for converting the three time-domain signals $r_1(n)$, $r_2(n)$, s(n) to time-frequency domain signals $R_1(l,k)$, $R_2(l,k)$ and S(l,k), respectively, e.g. using a Fourier transform, such as a discrete Fourier transform (DFT) or a Short-time Fourier transform (STFT). Each of the three time-frequency domain signals comprise a number K of frequency sub-band signals, k=1, . . . , K spanning a frequency range of operation (e.g. 0 to 10 kHz).

The signal processor (SPU) further comprises a noise estimator (NC) configured to determine a noise covariance matrix, e.g. a cross power spectral density (CPSD) matrix, $C_v(l,k)$. The noise estimator is configured to estimate $C_v(l,k)$ using the essentially noise-free target signal S(l,k) as a voice activity detector to determine the time-frequency regions in $R_1(l,k)$, $R_2(l,k)$, where the target speech is essentially absent. Based on these noise-dominant regions, $C_v(l,k)$ can be adaptively estimated, e.g. via recursive averaging as outlined in ref. [21] in [1].

The signal processor (SPU) further comprises a direction of arrival estimator ($DOAE_{MLE}$) configured to use a maximum likelihood methodology to estimate the direction-of-arrival DoA(l) of the target sound signal s(n) based on the time-frequency representations of the noisy microphone signals and the essentially noise-free target signal ($R_1(l,k)$, $R_2(l,k)$ and S(l,k), e.g. received from the respective analysis filter banks AFB), and (predetermined) relative transfer functions $d_m(k, \theta)$ read from memory unit RTF, and (adaptively determined) noise covariance matrices $C_v(l,k)$ received from the noise estimator (NC), as discussed above in connection with eq. (18), (19) (or (29), (30)).

The signal processor (SPU) further comprises a processing unit (PRO) for processing the noisy and/or clean target signals ($R_1(l,k)$, $R_2(l,k)$ and S(l,k)), e.g. including such processing that utilizes the estimate of the direction of arrival to improve intelligibility or loudness perception or spatial impression, e.g. for controlling a beamformer. The processing unit (PRO) provides enhanced (time-frequency representation) version S'(l,k) of the target signal to synthesis filter bank (FBS) for conversion to a time-domain signal s'(n).

The hearing device (HD) further comprises output unit (OU) for presenting enhanced target signal s'(n) to a user as stimuli perceivable as sound.

The hearing device (HD) may further comprise appropriate antenna and transceiver circuitry for forwarding or exchanging audio signals and/or DoA related information signals (e.g. DoA(l) or likelihood values) to/with another device, e.g. a separate processing device or a contralateral hearing device of a binaural hearing system.

Figure 3B:
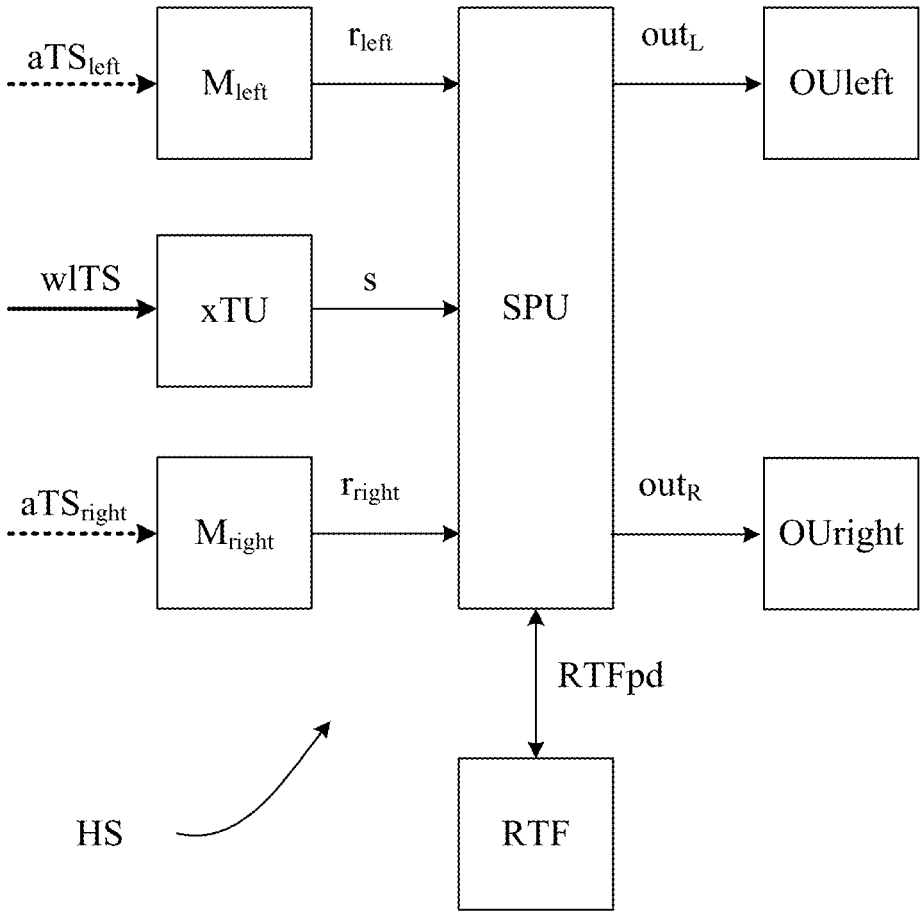
FIG. 3B shows a block diagram of an exemplary embodiment of a hearing system according to the present disclosure.

FIG. 3B shows a block diagram of an exemplary embodiment of a hearing system (HS) according to the present disclosure. The hearing system (HS) comprises at least one (here one) left input transducer ($M_{left}$, e.g. a microphone) for converting a received sound signal $aTS_{left}$ to an electric input signal ($r_{left}$), and at least one (here one) right input transducer ($M_{right}$, e.g. a microphone) for converting a received sound signal $aTS_{right}$ to an electric input signal ($r_{right}$). The input sound comprises a mixture of a target sound signal from a target sound source (S, see e.g. FIG. 1B, 2A, 2B) and a possible additive noise sound signal at the location of the at least one left and right input transducer, respectively. The hearing system further comprises a transceiver unit (xTU) configured to receive a wirelessly transmitted version wlTS of the target signal and providing an essentially noise-free (electric) target signal s. The hearing system further comprises a signal processor (SPU) operationally connected to the left and right input transducers ($M_{left}$), $M_{right}$), and to the wireless transceiver unit (xTU). The signal processor (SPU) is configured estimate a direction-of-arrival of the target sound signal s relative to the user as discussed above and in connection with FIG. 3A. In the embodiment of a hearing system (HS) of FIG. 3B, a database (RTF) of relative transfer functions accessible to the signal processor (SPU) via connection (or signal) RTFpd is shown as a separate unit. It may e.g. be implemented as an external database that is accessible via a wired or wireless connection, e.g. via a network, e.g. the Internet. In an embodiment, the database RTF form part of the signal processing unit (SPU), e.g. implemented as a memory wherein the relative transfer functions are stored (as in FIG. 3A). In the embodiment of FIG. 3B, the hearing system (HS) further comprises left and right output units $OU_{left}$ and $OU_{right}$, respectively, for presenting stimuli perceivable as sound to a user of the hearing system. The signal processor (SPU) is configured to provide left and right processed signals $out_L$ and $out_R$ to the left and right output units $OU_{left}$ and $OU_{right}$, respectively. In an embodiment the processed signals $out_L$ and $out_R$ comprises modified versions of the wirelessly received (essentially noise free) target signal s, wherein the modification comprises application of spatial cues corresponding to the estimated direction of arrival DoA. In the time domain, this may be achieved by convolving the target sound signal s(n) with respective relative impulse response functions corresponding to the current, estimated DoA. In the time-frequency domain, this may be achieved by multiplying the target sound signal S(l,k) with relative transfer functions (RFT) $d_m(k, \hat{\theta})$ (m=left, right) corresponding to the current, estimated DoA ($\hat{\theta}$), to provide left and right modified target signals $\hat{s}_L$ and $\hat{s}_R$, respectively. The processed signals $out_L$ and $out_R$ may e.g. comprise a weighted combination of the respective received sound signals $r_{left}$ and $r_{right}$, and the respective modified target signals $\hat{s}_L$ and $\hat{s}_R$, e.g. to provide that $out_L=w_{L1}\ r_{left}+w_{L2}\ \hat{s}_L$, and $out_R=w_{R1}\ r_{right}+w_{R2}\ \hat{s}_R$, to provide a sense of ambience to the otherwise clean target signal (in addition to the spatial cues). In an embodiment, the weights are adapted to provide that the processed signals $out_L$ and $out_R$ are dominated by (such as equal to) the respective modified target signals $\hat{s}_L$ and $\hat{s}_R$. A more detailed description of an embodiment of the signal processor (SPU) in FIG. 3B is discussed in the following in connection with FIG. 3C.

Figure 3C:
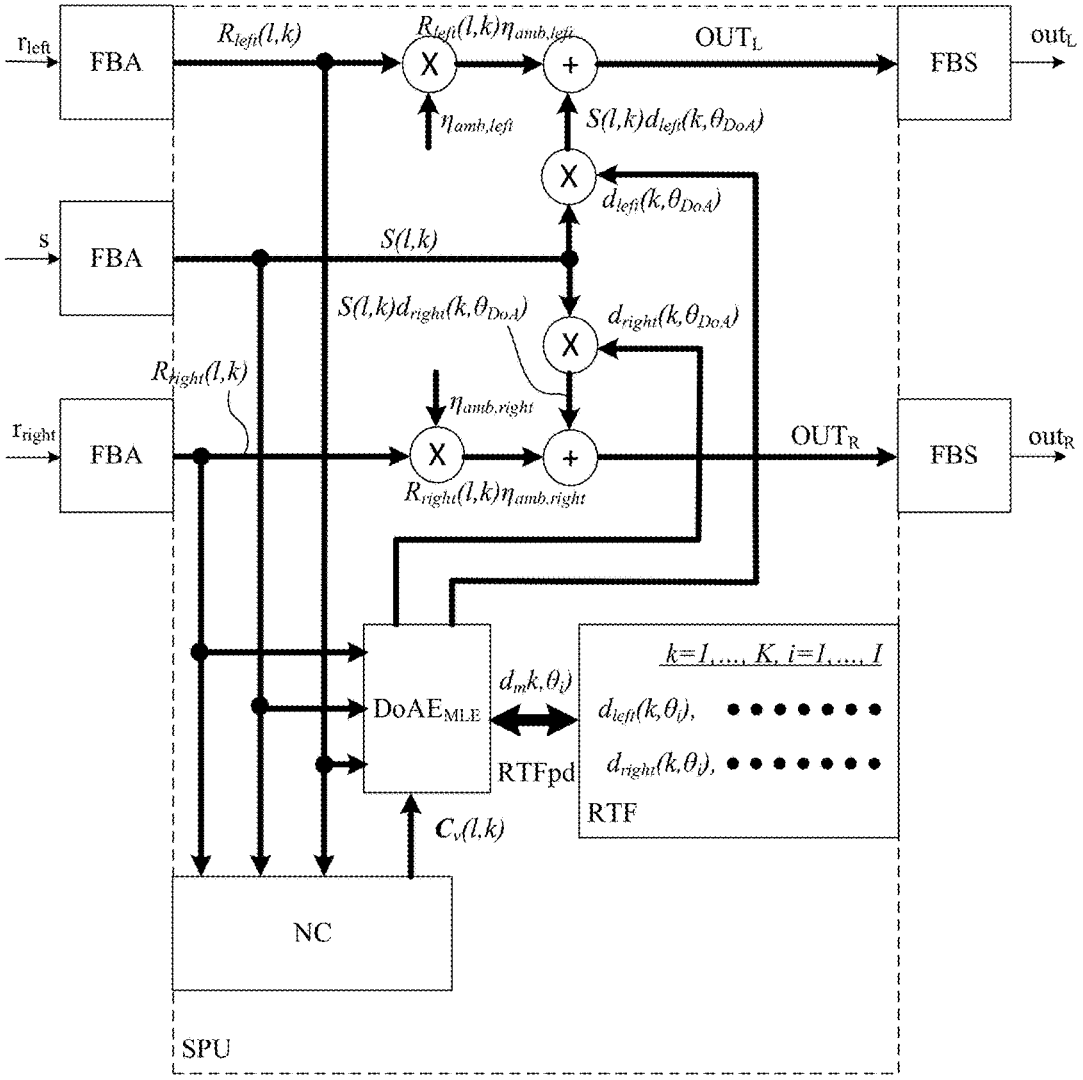
FIG. 3C shows partial block diagram of an exemplary embodiment of a signal processor for the hearing system of FIG. 3B.

FIG. 3C shows partial block diagram of an exemplary embodiment of a signal processor (SPU) for the hearing system of FIG. 3B. In FIG. 3C, the database of relative transfer functions form part of the signal processor, though, e.g. embodied in a memory (RTF) storing the relevant transfer functions $d_m(k, \theta)$ (m=left, right). The embodiment of a signal processor (SPU) shown in FIG. 3C comprises the same functional blocks as the embodiment shown in FIG. 3A. The common functional units are: noise estimator (NC), memory unit (RTF), and direction of arrival estimator ($DOAE_{MLE}$), all assumed to provide equivalent functionality in the two embodiments. In addition to these functional blocks, the signal processor of FIG. 3C comprises elements for applying appropriate spatial cues to the clean version of the target signal S(l,k). Analysis filter banks (FBA) and synthesis filter bank (FBS) are connected to the respective input and output units and to the signal processor (SPU).

The direction of arrival estimator ($DOAE_{MLE}$) provides relative transfer functions (RFT) $d_m(k, \hat{\theta})$ (m=left, right) corresponding to the current, estimated DoA ($\hat{\theta}$) (in FIG. 3C, $\hat{\theta}=\theta_{DoA}$). The signal processor comprises combination units (here multiplication units 'X') for applying respective relative transfer functions $d_{left}(k, \theta_{DoA})$ and $d_{right}(k, \theta_{DoA})$ to the clean version of the target signal S(l,k), respectively, and providing respective spatially improved (clean) target signals $S(l,k)\cdot d_{left}(k, \theta_{DoA})$ and $S(l,k)\cdot d_{right}(k, \theta_{DoA})$ to be (optionally further processed and) presented at the left and right ears of a user, respectively. These signals may be provided directly as processed output signals $OUT_L$ and $OUT_R$, respectively, to the synthesis filter bank (FBS) for conversion to time-domain outputs signal $out_L$ and $out_R$, respectively, for presentation to the user as essentially noise-free target signals comprising cues providing perception of the spatial location of the target signal. The signal processor (SPU) of FIG. 3C comprises combination units (here multiplication units 'X' followed by sum units '+') allowing the left and right processed output signals $OUT_L$ and $OUT_R$ to provide a sense of the acoustic environment (e.g. a sense of a room) by adding, possibly scaled versions (cf. (possibly frequency dependent) multiplication factors $\eta_{amb,left}$ and $\eta_{amb,right}$, respectively) of the noisy target signals ($R_{left}(l,k)$ and $R_{right}(l,k)$) at the left and right hearing devices to the spatially improved (clean) target signals $S(l,k)\cdot d_{left}(k, \theta_{DoA})$ and $S(l,k)\cdot d_{right}(k, \theta_{DoA})$, respectively. In an embodiment, the spatially improved (clean) target signals are scaled with respective scaling factors $(1-\eta_{amb,left})$ and $(1-\eta_{amb,right})$, respectively. In an embodiment, the spatially improved left and right target signals are multiplied by a fading factor $\alpha$ (e.g. in connection with distance dependent scaling) such that full weight (e.g. $\alpha=1$) is applied to the spatially reconstructed wireless signal if the target sound source is relatively far away from the user, and full weight (e.g. $\alpha=0$) is applied to the hearing aid microphone signals, in case of a nearby target sound source. The terms 'relatively far away' and 'nearby' may be made dependent on an estimated reverberation time or of a direct to reverberant ratio, or similar measure. In an embodiment, a component of the hearing aid microphone signals is always present in the resulting signal(s) presented to the user (i.e. $\alpha<1$, e.g. $\leq 0.95$ or ≤0.9). The fading factor $\alpha$ may be integrated in the scaling factors $\eta_{amb,left}$ and $\eta_{amb,right}$.

The memory unit (RTF) comprises M (here two) sets relative transfer functions from a reference microphone (one of the two) to the other(s), so here in reality one set), each set of relative transfer functions comprising values for different DoA (e.g. angles $\theta_i$, i=1, 2, . . . , I) at a number of frequencies k, k=1, 2, . . . , K. If, for example, the right microphone is taken to be the reference microphone, the right relative transfer functions are equal to 1 (for all angles and frequencies). For M=2, d=($d_1$, $d_2$). If microphone 1 is the reference microphone, d(θ, k)=(1, $d_2$(θ, k)). This represent one way of scaling or normalizing the look vector. Other way may be used according to the application in question.

Figure 4A:
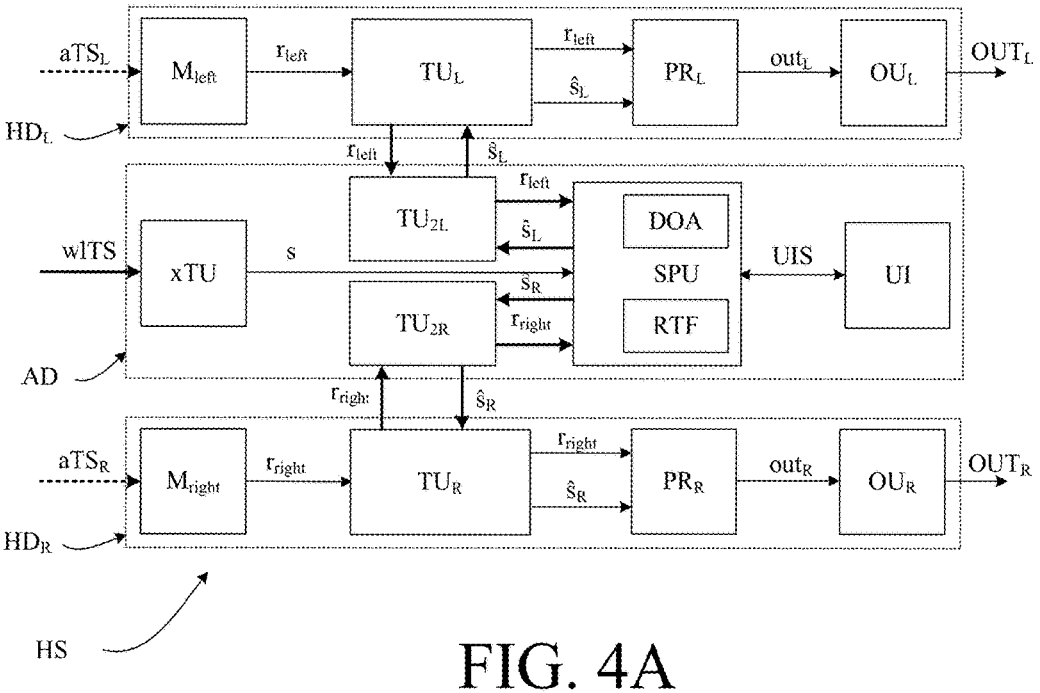
FIG. 4A shows a binaural hearing system comprising first and second hearing devices comprising a binaural direction of arrival estimator according to a first embodiment of the present disclosure.

FIG. 4A shows a binaural hearing system (HS) comprising first and second hearing devices ($HD_L$, $HD_R$) comprising a binaural direction of arrival estimator according to a first embodiment of the present disclosure. The embodiment of FIG. 4A comprises the same functional elements as the embodiment of FIG. 3B, but is specifically partitioned in (at least) three physically separate devices. The left and right hearing devices ($HD_L$, $HD_R$), e.g. hearing aids, are adapted to be located at left and right ears, respectively, or to be fully or partially implanted in the head at the left and right ears of a user. The left and right hearing devices ($HD_L$, $HD_R$) comprises respective left and right microphones ($M_{left}$, $M_{right}$) for converting received sound signals to respective electric input signals ($r_{left}$, $r_{right}$). The left and right hearing devices ($HD_L$, $HD_R$) further comprises respective transceiver units ($TU_L$, $TU_R$) for exchanging audio signals and/or information/control signals with each other, respective processing units ($PR_L$, $PR_R$) for processing one or more input audio signals and providing one or more processed audio signals ($out_L$, $out_R$), and respective output units ($OU_L$, $OU_R$) for presenting respective processed audio signals ($out_L$, $out_R$) to the user as stimuli ($OUT_L$, $OUT_R$) perceivable as sound. The stimuli may e.g. be acoustic signals guided to the ear drum, vibration applied to the skull bone, or electric stimuli applied to electrodes of a cochlear implant. The auxiliary device (AD) comprises a first transceiver unit ($xTU_1$) for receiving a wirelessly transmitted signal wITS, and providing an electric (essentially noise-free) version of the target signal s. The auxiliary device (AD) further comprises respective second left and right transceiver units ($TU_{2L}$, $TU_{2R}$) for exchanging audio signals and/or information/control signals with the left and right hearing device ($HD_L$, $HD_R$), respectively. The auxiliary device (AD) further comprises a signal processor (SPU) for estimating a direction of arrival (cf. subunit DOA) of the target sound signal relative to the user. The left and right electric input signals ($r_{left}$, $r_{right}$) received by the respective microphones ($M_{left}$, $M_{right}$) of the left and right hearing devices ($HD_L$, $HD_R$), respectively, are transmitted to the auxiliary device (AD) via respective transceivers ($TU_L$, $TU_R$) in the left and right hearing devices ($HD_L$, $HD_R$) and respective second transceivers ($TU_{2L}$, $TU_{2R}$) in the auxiliary device (AD). The left and right electric input signals ($r_{left}$, $r_{right}$) as received in the auxiliary device (AD) are fed to the signal processing unit together with the target signal s as received by first transceiver ($TU_1$) of the auxiliary device. Based thereon (and on a propagation model and a database of relative transfer functions (RTF) $d_m$(k, θ)), the signal processor estimates a direction of arrival (DOA) of the target signal, and applies respective head relative related transfer functions (or impulse responses) to the wirelessly received version of the target signal s to provide modified left and right target signals $\hat{s}_L$, $\hat{s}_R$, which are transmitted to the respective left and right hearing devices via the respective transceivers. In the left and right hearing devices ($HD_L$, $HD_R$), the modified left and right target signals $\hat{s}_L$, $\hat{s}_R$ are fed to respective processing units ($PR_L$, $PR_R$) together with the respective left and right electric input signals ($r_{left}$, $r_{right}$). The processing units ($PR_L$, $PR_R$) provides respective left and right processed audio signals ($out_L$, $out_R$), e.g. frequency shaped according to a user's needs, and/or mixed in an appropriate ratio to ensure perception of the (clean) target signal ($\hat{s}_L$, $\hat{s}_R$) with directional cues reflecting an estimated direction of arrival, as well as giving a sense of the environment sound (via signals ($r_{left}$, $r_{right}$)).

Figure 9A:
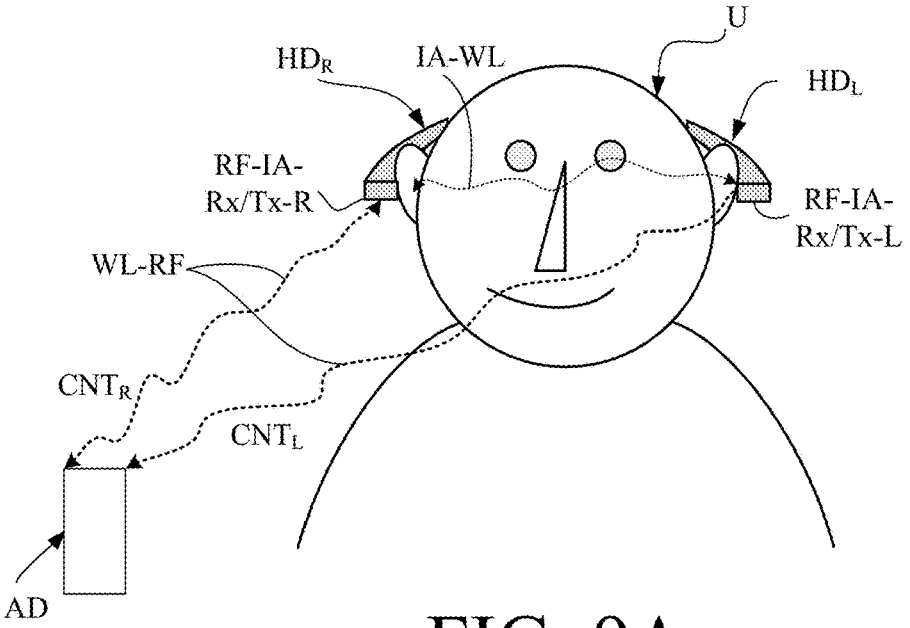
FIG. 9A illustrates a third embodiment of a hearing system according to the present disclosure comprising left and right hearing devices in communication with an auxiliary device.
Figure 9B:
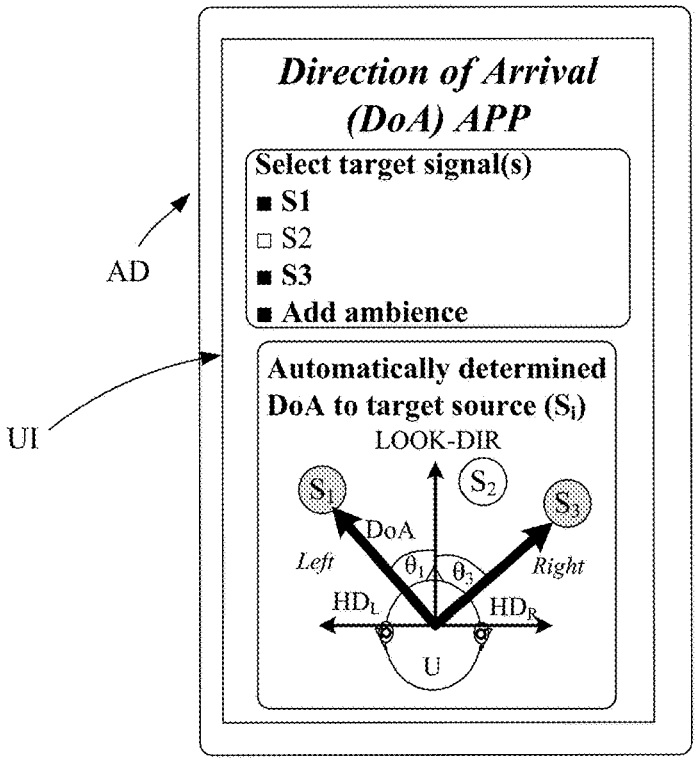
FIG. 9B shows the auxiliary device of FIG. 9A comprising a user interface of the hearing system, e.g. implementing a remote control for controlling functionality of the hearing system.

The auxiliary device (AD) further comprises a user interface (UI) allowing a user to influence functionality of the hearing aid system (HS) (e.g. a mode of operation) and/or for presenting information regarding the functionality to the user (via signal UIS), cf. FIG. 9B. An advantage of using an auxiliary device for some of the tasks of the hearing system is that it may comprise more battery capacity, more computational power, more memory (e.g. more RTF-values, e.g. providing a finer resolution of location and frequency), etc.

The auxiliary device may e.g. be implemented as a (part of a) communication device, e.g. a cellular telephone (e.g. a smartphone) or a personal digital assistant (e.g. a portable, e.g. wearable, computer, e.g. implemented as a tablet computer or a watch, or similar device).

In the embodiment of FIG. 4A the first and second transceivers of the auxiliary device (AD) are shown as separate units ($TU_1$, $TU_{2L}$, $TU_{2R}$). The transceivers may be implemented as two or one transceiver according to the application in question (e.g. depending on the nature (near-field, far-field) of the wireless links and/or the modulation scheme or protocol (proprietary or standardized, NFC, Bluetooth, ZigBee, etc.).

Figure 4B:
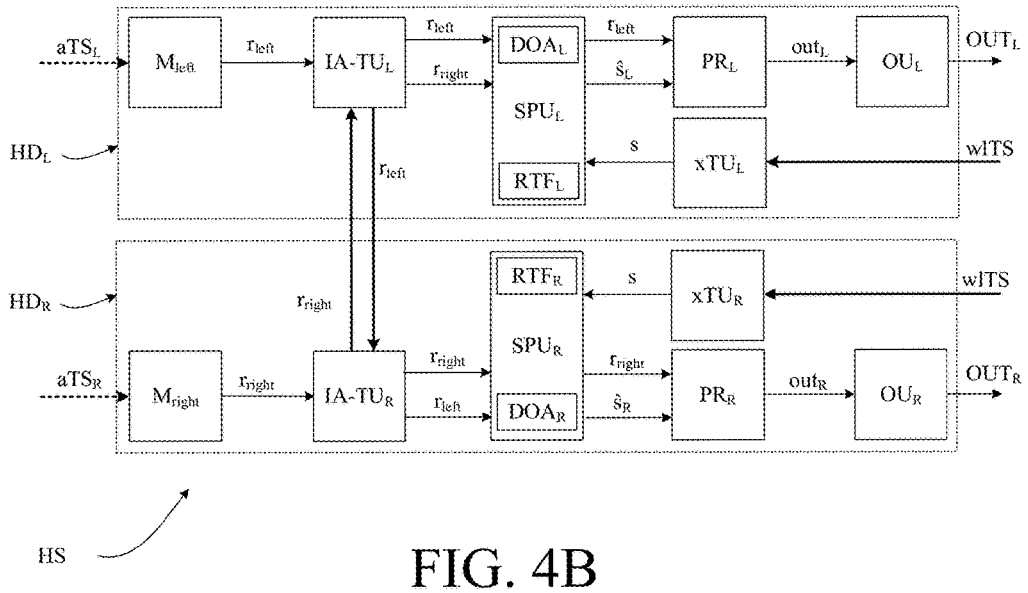
FIG. 4B shows a binaural hearing system comprising first and second hearing devices comprising a binaural direction of arrival estimator according to a second embodiment of the present disclosure.

FIG. 4B shows a binaural hearing system (HS) comprising first and second hearing devices ($HD_L$, $HD_R$) comprising a binaural direction of arrival estimator according to a second embodiment of the present disclosure. The embodiment of FIG. 4B comprises the same functional elements as the embodiment of FIG. 4A, but is specifically partitioned in two physically separate devices, left and right hearing devices, e.g. hearing aids ($HD_L$, $HD_R$). In other words, the processing which is performed in the auxiliary device (AD) in the embodiment of FIG. 4A is performed in each of the hearing devices ($HD_L$, $HD_R$) in the embodiment of FIG. 4B. The user interface may e.g. still be implemented in an auxiliary device, so that presentation of information and control of functionality can be performed via the auxiliary device (cf. e.g. FIG. 9B). In the embodiment of FIG. 4B, only the respective received electrical signals ($r_{left}$, $r_{right}$) from respective microphones ($M_{left}$, $M_{right}$) are exchanged between the left and right hearing devices (via left and right interaural transceivers IA-$TU_L$ and IA-$TU_R$, respectively). On the other hand, separate wireless transceivers ($xTU_L$, $xTU_R$) for receiving the (essentially noise free version of the) target signal s are included in the left and right hearing devices ($HD_L$, $HD_R$). The onboard processing may provide an advantage in the functionality of the hearing aid system (e.g. reduced latency) but may come at the cost of an increased power consumption of the hearing devices ($HD_L$, $HD_R$). Using onboard left and right databases of relative transfer functions (RTF), cf. sub-units $RTF_L$, $RTF_R$, and left and right estimates of the direction of arrival of the target signal s, cf. sub-units $DOA_L$, $DOA_R$, the individual signal processors ($SPU_L$, $SPU_R$) provides modified left and right target signals $\hat{s}_L$, $\hat{s}_R$, respectively, which are fed to respective processing units ($PR_L$, $PR_R$) together with the respective left and right electric input signals ($r_{left}$, $r_{right}$), as described in connection with FIG. 4A. The signal processors ($SPU_L$, $SPU_R$) and the processing units ($PR_L$, $PR_R$) of the left and right hearing devices ($HD_L$, $HD_R$), respectively, are shown as separate units but may of course be implemented as one functional signal processing unit that provides (mixed) processed audio signals ($out_L$, $out_R$), e.g. a weighted combination based on the left and right (acoustically) received electric input signals ($r_{left}$, $r_{right}$) and the modified left and right (wirelessly received) target signals $\hat{s}_L$, $\hat{s}_R$, respectively. In an embodiment, the estimated direction of arrival ($DOA_L$, $DOA_R$) of the left and right hearing devices are exchanged between the hearing devices and used in the respective signal processing units ($SPU_L$, $SPU_R$) to influence an estimate of a resulting DoA, which may used in the determination of respective resulting modified target signals $\hat{s}_L$, $\hat{s}_R$.

The description so far has assumed that the wireless microphone is located on the target source, e.g. at the ears, and/or elsewhere on the head of a user, e.g. on the forehead or distributed around a periphery of the head (e.g. on a headband, a cap or other headwear, glasses, or the like). It is, however, not necessary that the microphone is worn by the target sound source. The wireless microphone could e.g. be a table microphone which happens to be located close to the target sound source—similarly, the wireless microphone may not consist of a single microphone, but could be a directional microphone, or even an adaptive beamforming/noise reduction system which happens to be in the vicinity of the target source at a particular moment in time. Such scenarios are illustrated in the following FIG. 5-8 wherein a user (U) wearing a binaural hearing system according to the present disclosure comprising left and right hearing devices ($HD_L$, $HD_R$) faces three potential target sound sources (persons $S_1$, $S_2$, $S_3$). The user may chose at a given point in time (e.g. via a user interface in a remote control, e.g. a smartphone) which one or more of the target sound sources he wants to listen to. Alternatively, the table microphone may be configured to zoom in on the current talker. Different microphone setups for the wireless transmission of the target sound signal to the user's hearing devices ($HD_L$, $HD_R$) are illustrated. The present configuration (e.g. which audio source to listen to at a given time) may e.g. controlled by the user (U) via a user interface, e.g. an APP of a smartphone or similar device (cf. e.g. FIG. 9A, 9B). In an embodiment, a preceding authentication procedure (e.g. pairing) between the hearing aid system (hearing devices ($HD_L$, $HD_R$)) and the 'remote' wireless microphones (e.g. speaker microphones (or termed 'speakerphones') $SPM_1$, $SPM_3$ in FIG. 5, table microphone TMS in FIGS. 6 and 7, and smartphones $SMP_1$, $SMP_3$ in FIG. 8) is assumed. The number of microphones of the hearing system (e.g. M=4, e.g. two on each hearing device) may be larger or smaller than or equal to the number (N) of wirelessly received noise-free target signals $s_i$ (e.g. N=2 as in FIG. 5, 7, 8). The wireless reception of more than one target signal $s_i$ can e.g. be achieved by arranging separate wireless receivers in the hearing devices ($HD_L$, $HD_R$). Preferably, a transceiver technology allowing the reception of more than one simultaneous wireless channel with the same transceiver can be used (e.g. technology that allows several devices to be simultaneously authenticated to communicate with each other, e.g. a Bluetooth-like technology, such as a Bluetooth Low Energy-like technology).

Figure 5:
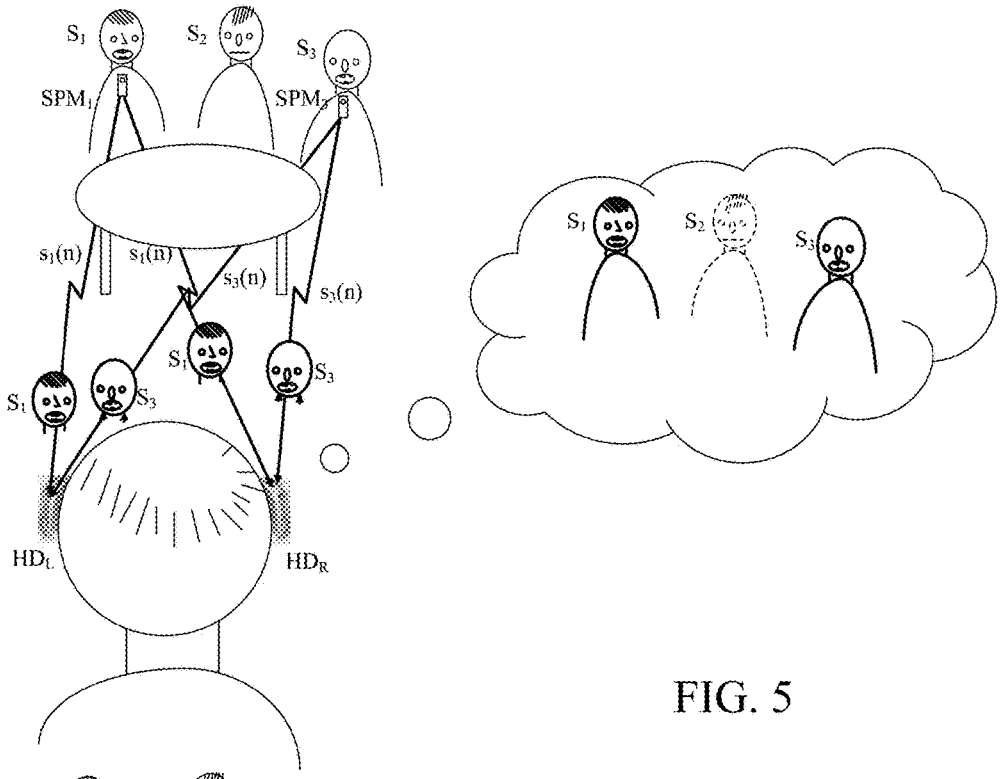
FIG. 5 shows a first use scenario of a binaural hearing system according to an embodiment of the present disclosure.

FIG. 5 shows a first use scenario of a binaural hearing system according to an embodiment of the present disclosure. The scenario of FIG. 5 illustrating a DOA estimation using external microphones ($SPM_1$, $SPM_3$) can easily handle multiple external sound channels in parallel. Each talker ($S_1$, $S_3$) wearing a microphone transmits the microphone signal ($s_1(n)$, $s_3(n)$) wirelessly to the two hearing instruments ($HD_L$, $HD_R$). Each hearing instrument thus receives two mono signals—each received signal mainly contains the clean speech signal of the talker wearing the microphones. For each received wireless signal we may thus apply the informed DOA procedure according to the present disclosure in order to independently estimate the direction of arrival of each talker. When the DOA of each talker wearing a microphone has been estimated, spatial cues corresponding to the estimated DOAs can be applied to each of the received signals. Hereby it is possible to present a spatially segregated mixture of the received wireless speech signals, cf. e.g. FIG. 11A, 11B. A voice activity detector (VAD) (or an SNR-detector) located in the respective speaker microphones may be used to detect which of the near-field sounds is the closest to the speaker microphone in question (and this to be focused on by that speaker microphone). Such detection may be provided by a near-field sound detector evaluating distance to audio source based on level difference between adjacent microphones of the near-field detector (such microphones being e.g. located in the speaker microphone).

Figure 6:
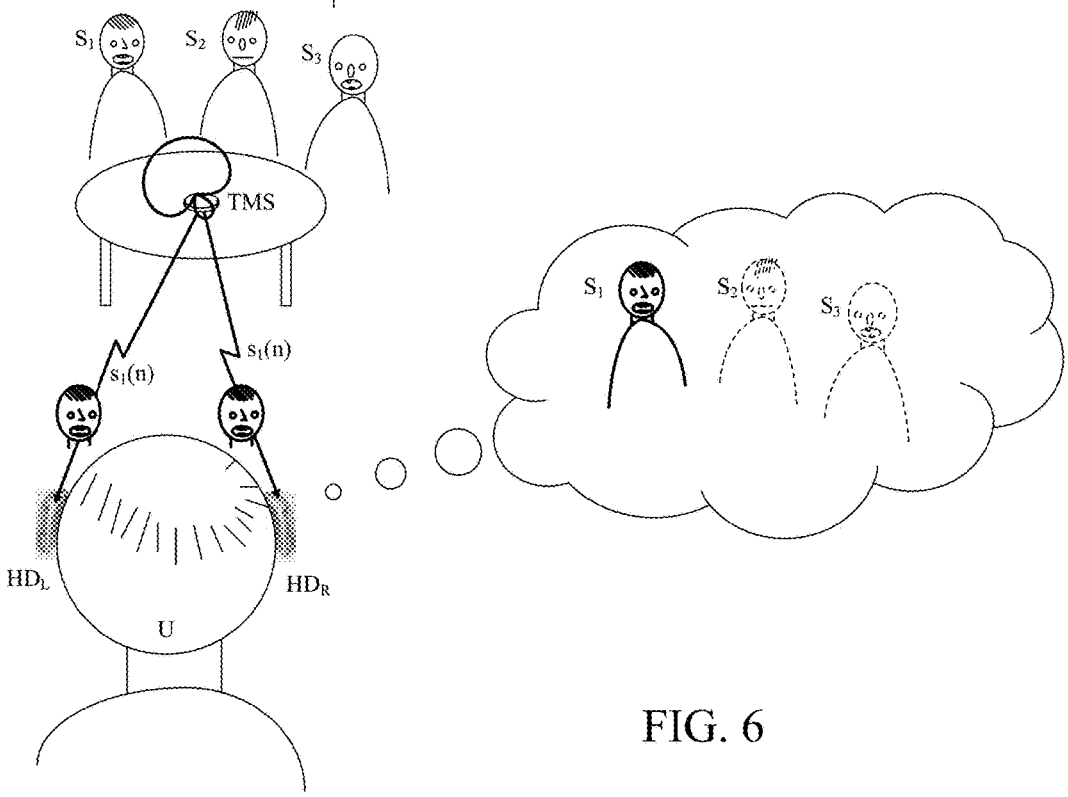
FIG. 6 shows a second use scenario of a binaural hearing system according to an embodiment of the present disclosure.

FIG. 6 shows a second use scenario of a binaural hearing system according to an embodiment of the present disclosure. The scenario of FIG. 6 illustrates that the informed DOA does not necessarily require that the external microphone is close to the mouth. The external microphone may as well be a table microphone (array, TMS), which is able to capture the target of interest (here $S_1$) and attenuate unwanted noise sources (cf. beamformer schematically indicated towards target sound source $S_1$) in order to achieve a 'clean' version of the target signal ($s_1(n)$) having a higher signal to noise ratio compared to what is possible to achieve solely by the hearing instrument microphones. The DoA determined according to the present disclosure may e.g. be used to control (update) the beamformer of the table microphone (TMS), e.g. to improve its directionality towards the target sound source ($S_1$) intended to be listened to by the user (U), e.g. via an APP of a remote control used to select $S_1$ (e.g. via screen shown in FIG. 9B). In an embodiment, an automatic estimation of target direction, e.g. based on blind source separation techniques as described in the art, is used. The same beamformer selection and update procedure can be applied in the scenarios of FIGS. 7 and 8.

Figure 7:
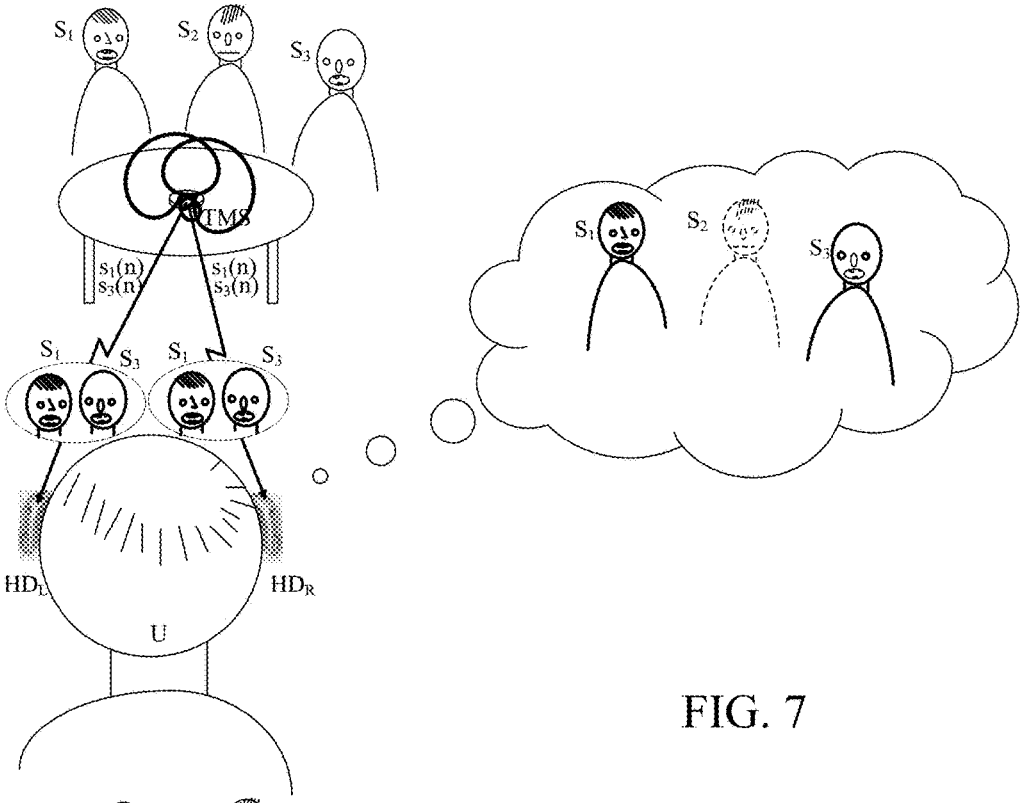
FIG. 7 shows a third use scenario of a binaural hearing system according to an embodiment of the present disclosure.

FIG. 7 shows a third use scenario of a binaural hearing system according to an embodiment of the present disclosure. FIG. 7 shows a scenario similar to the use case of FIG. 5, where several clean mono signals were transmitted from microphones placed on talkers of interest, a (table) microphone array (TMS) may be able to zoom in on individual talkers hereby obtaining different clean speech estimates (cf. schematic beamformers directed towards target sound sources $S_1$ and $S_3$). Each clean speech estimate ($s_1(n)$, $s_3(n)$) is transmitted to the hearing instruments ($HD_L$, $HD_R$) and for each received speech signal, the informed DOA procedure may be used to estimate each signal's direction of arrival. Again, the DOAs may be used to create a spatially correct mixture from the wirelessly received signals.

Figure 8:
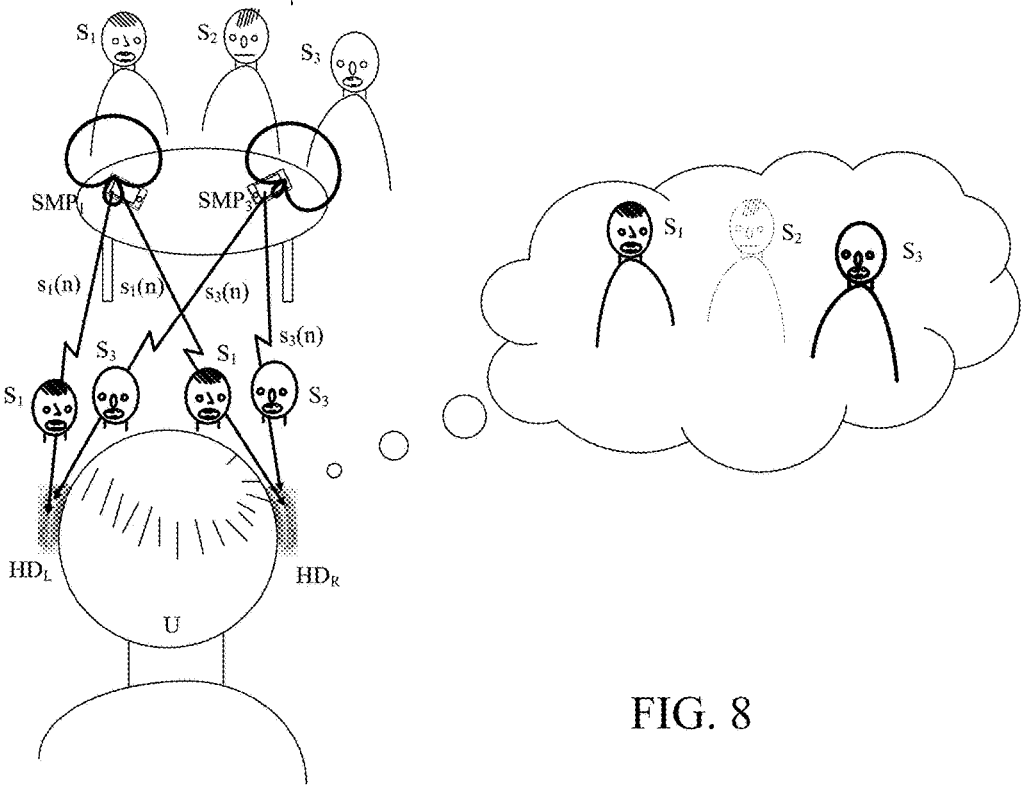
FIG. 8 shows a fourth use scenario of a binaural hearing system according to an embodiment of the present disclosure.

FIG. 8 shows a fourth use scenario of a binaural hearing system according to an embodiment of the present disclosure. FIG. 8 shows a situation similar to the problem mentioned in FIG. 5 and FIG. 7, different smartphones ($SMP_1$, $SMP_3$) each capable of extracting a single speech signal, may be used to transmit enhanced/clean versions ($s_1(n)$, $s_3(n)$) of different talkers ($S_1$ and $S_3$) to the hearing instruments ($HD_L$, $HD_R$). From the received clean estimates ($s_1(n)$, $s_3(n)$) and the hearing aid microphones, the DOA of each talker may be estimated using the informed DOA procedure according to the present disclosure.

FIG. 9A illustrates an embodiment of a hearing system according to the present disclosure. The hearing system comprises left and right hearing devices ($HD_L$, $HD_R$, e.g. hearing aids) in communication with an auxiliary device (AD), e.g. a remote control device, e.g. a communication device, such as a cellular telephone or similar device capable of establishing a communication link to one or both of the left and right hearing devices.

FIG. 9A, 9B shows an application scenario comprising an embodiment of a binaural hearing system comprising first and second hearing devices ($HD_R$, $HD_L$) and an auxiliary device (AD) according to the present disclosure. The auxiliary device (AD) comprises a cellular telephone, e.g. a SmartPhone. In the embodiment of FIG. 9A, the hearing devices and the auxiliary device are configured to establish wireless links (WL-RF) between them, e.g. in the form of digital transmission links according to the Bluetooth standard (e.g. Bluetooth Low Energy). The links may alternatively be implemented in any other convenient wireless and/or wired manner, and according to any appropriate modulation type or transmission standard, possibly different for different audio sources. The auxiliary device (AD, e.g. a SmartPhone) of FIG. 9A, 9B comprises a user interface (UI) providing the function of a remote control of the hearing system, e.g. for changing program or operating parameters (e.g. volume) in the hearing device(s), etc. The user interface (UI) of FIG. 9B illustrates an APP (denoted 'Direction of Arrival (DoA) APP') for selecting a mode of operation of the hearing system where spatial cues are added to audio signals streamed to the left and right hearing devices ($HD_L$, $HD_R$). The APP allows a user to select one or more of a number of available streamed audio sources (here $S_1$, $S_2$, $S_3$). In the screen of FIG. 9B, sources $S_1$ and $S_3$ have been selected as indicated by the left solid 'tick-box' and the bold face indication (and the grey shading of sources $S_1$ and $S_3$ in the illustration of the acoustic scene). In this sound scene, the direction of arrival of target sound sources $S_1$ and $S_3$ are automatically determined (as described in the present disclosure) and the result is displayed in the screen by circular symbol denoted S and bold arrow denoted DoA schematically shown relative to the head of the user to reflect its estimated location. This is indicated by the text Automatically determined DoA to target source ($S_i$) in the lower part of the screen in FIG. 9B. Before selecting which of a number of currently available sound sources (here S1, S2, S3, cf. e.g. FIG. 5-8) a user may initially indicate the optionally available target sound source via the user interface (UI), e.g. by moving a sound source symbol ($S_i$) to an estimated location on the screen relative to the user's head (thereby also creating the list of currently available sound sources in the middle of the screen). A user may subsequently indicate one or more of the sound sources that he or she is interested in listening to (by selection from the list in the middle of the screen), and then the specific direction of arrival is determined according to the present disclosure (whereby the calculations may be simplified by excluding a part of the possible space).

In an embodiment, the hearing aid system is configured to apply appropriate transfer functions to the wirelessly received (streamed) target audio signal to reflect the direction of arrival determined according to the present disclosure. This has the advantage of providing a sensation of the spatial origin of the streamed signal to the user. Preferably, appropriate head related transfer functions HRTF are applied to the streamed signals from the selected sound sources.

In an embodiment, acoustic ambience from the local environment can be added (using weighted signals from one or more of the microphones of the hearing devices), cf. tick box Add ambience.

In an embodiment, the calculations of the direction of arrival are performed in the auxiliary device (cf. e.g. FIG. 4A). In another embodiment, the calculations of the direction of arrival are performed in the left and/or right hearing devices (cf. e.g. FIG. 4B). In the latter case the system is configured to exchange the audio signals or data defining the direction of arrival of the target sound signal between the auxiliary device and the hearing device(s).

The hearing device ($HD_L$, $HD_R$) are shown in FIG. 9A as devices mounted at the ear (behind the ear) of a user U. Other styles may be used, e.g. located completely in the ear (e.g. in the ear canal), fully or partly implanted in the head, etc. Each of the hearing instruments comprise a wireless transceiver to establish an interaural wireless link (IA-WL) between the hearing devices, here e.g. based on inductive communication. Each of the hearing devices further comprises a transceiver for establishing a wireless link (WL-RF, e.g. based on radiated fields (RF)) to the auxiliary device (AD), at least for receiving and/or transmitting signals ($CNT_R$, $CNT_L$), e.g. control signals, e.g. information signals (e.g. present DoA, or likelihood values), e.g. including audio signals. The transceivers are indicated by RF-IA-Rx/Tx-R and RF-IA-Rx/Tx-L in the right and left hearing devices, respectively.

Figure 10:
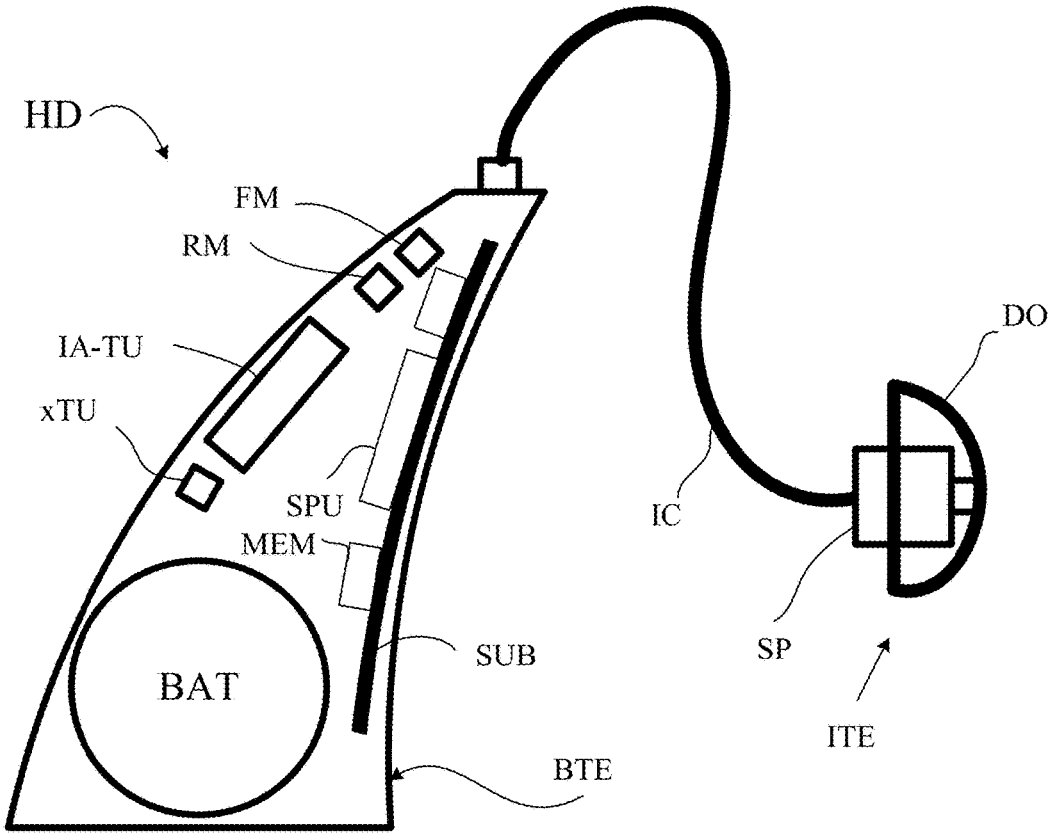
FIG. 10 illustrates an embodiment of a receiver-in-the-ear BTE-type hearing aid according to the present disclosure.

FIG. 10 shows an exemplary hearing device, which may form part of a hearing system according to the present disclosure. The hearing device (HD) shown in FIG. 10, e.g. a hearing aid, is of a particular style (sometimes termed receiver-in-the ear, or RITE, style) comprising a BTE-part (BTE) adapted for being located at or behind an ear of a user and an ITE-part (ITE) adapted for being located in or at an ear canal of a user's ear and comprising a receiver (loudspeaker, SP). The BTE-part and the ITE-part are connected (e.g. electrically connected) by a connecting element (IC).

In the embodiment of a hearing device (HD) in FIG. 10, e.g. a hearing aid, the BTE part comprises two input transducers (e.g. microphones) (FM, RM, corresponding to the front ($FM_x$) and rear ($RM_x$) microphones, respectively, of FIG. 1B, x=L, R) each for providing an electric input audio signal representative of an input sound signal (e.g. a noisy version of a target signal). In another embodiment, a given hearing device comprise only one input transducer (e.g. one microphone). In still another embodiment the hearing device comprise three or more input transducers (e.g. microphones). The hearing device (HD) of FIG. 10 further comprises two wireless transceivers (IA-TU, xTU) for availing reception and/or transmission of respective audio and/or information or control signals. In an embodiment, xTU is configured to receive an essentially noise-free version of the target signal from a target sound source, and IA-TU is configured to transmit or receive audio signals (e.g. microphone signals, or (e.g. band-limited) parts thereof) and/or to transmit or receive information (e.g. related to the localization of the target sound source, e.g. estimated DoA values, or likelihood values) to/from a contralateral hearing device of a binaural hearing system, e.g. a binaural hearing aid system or from an auxiliary device (cf. e.g. FIG. 4A, 4B). The hearing device (HD) comprises a substrate (SUB) whereon a number of electronic components are mounted, including a memory (MEM). The memory is configured to store relative transfer functions RTF(k, θ) ($d_m$(k, θ), k=1, . . . , K, m=1, . . . , M) from a given microphone of the hearing device (HD) to other microphones of the hearing device and/or of a hearing system, which the hearing device form part of, e.g. to one or more microphones of contralateral hearing device. The BTE-part further comprises a configurable signal processor (SPU) adapted to access the memory (MEM) comprising the (predefined) relative transfer functions and for selecting and processing one or more of the electric input audio signals and/or one or more of the directly received auxiliary audio input signals, based on a current parameter setting (and/or on inputs from a user interface). The configurable signal processor (SPU) provides an enhanced audio signal, which may be presented to a user or further processed or transmitted to another device as the case may be. In an embodiment, the configurable signal processor (SPU) is configured to apply spatial cues to a wirelessly received (essentially noise-free) version of the target signal (see e.g. signal S(l,k) in FIG. 3A) based on the estimated direction of arrival $\hat{\theta}$. Relative transfer functions $d_m(\hat{\theta})$ corresponding to the estimated DoA ($\hat{\theta}$) may preferably be used to determine a resulting enhanced signal for presentation to a user (see e.g. signal S'(l,k) in FIG. 3A, or signals $OUT_L$, $OUT_R$ in FIG. 3C).

The hearing device (HD) further comprises an output unit (e.g. an output transducer or electrodes of a cochlear implant) providing an enhanced output signal as stimuli perceivable by the user as sound based on said enhanced audio signal or a signal derived therefrom In the embodiment of a hearing device in FIG. 10, the ITE part comprises the output unit in the form of a loudspeaker (receiver) (SP) for converting a signal to an acoustic signal. The ITE-part further comprises a guiding element, e.g. a dome, (DO) for guiding and positioning the ITE-part in the ear canal of the user.

The hearing device (HD) exemplified in FIG. 10 is a portable device and further comprises a battery (BAT), e.g. a rechargeable battery, for energizing electronic components of the BTE- and ITE-parts.

In an embodiment, the hearing device, e.g. a hearing aid (e.g. the signal processor), is adapted to provide a frequency dependent gain and/or a level dependent compression and/or a transposition (with or without frequency compression) of one or more source frequency ranges to one or more target frequency ranges, e.g. to compensate for a hearing impairment of a user.

In an embodiment, enhanced spatial cues are provide to the user by frequency lowering (where frequency content are moved or copied from a higher frequency band to a lower frequency band; typically to compensate for a severe hearing loss at higher frequencies). A hearing system according to the present disclosure may e.g. comprise left and right hearing devices as shown in FIG. 10.

Figure 11A:
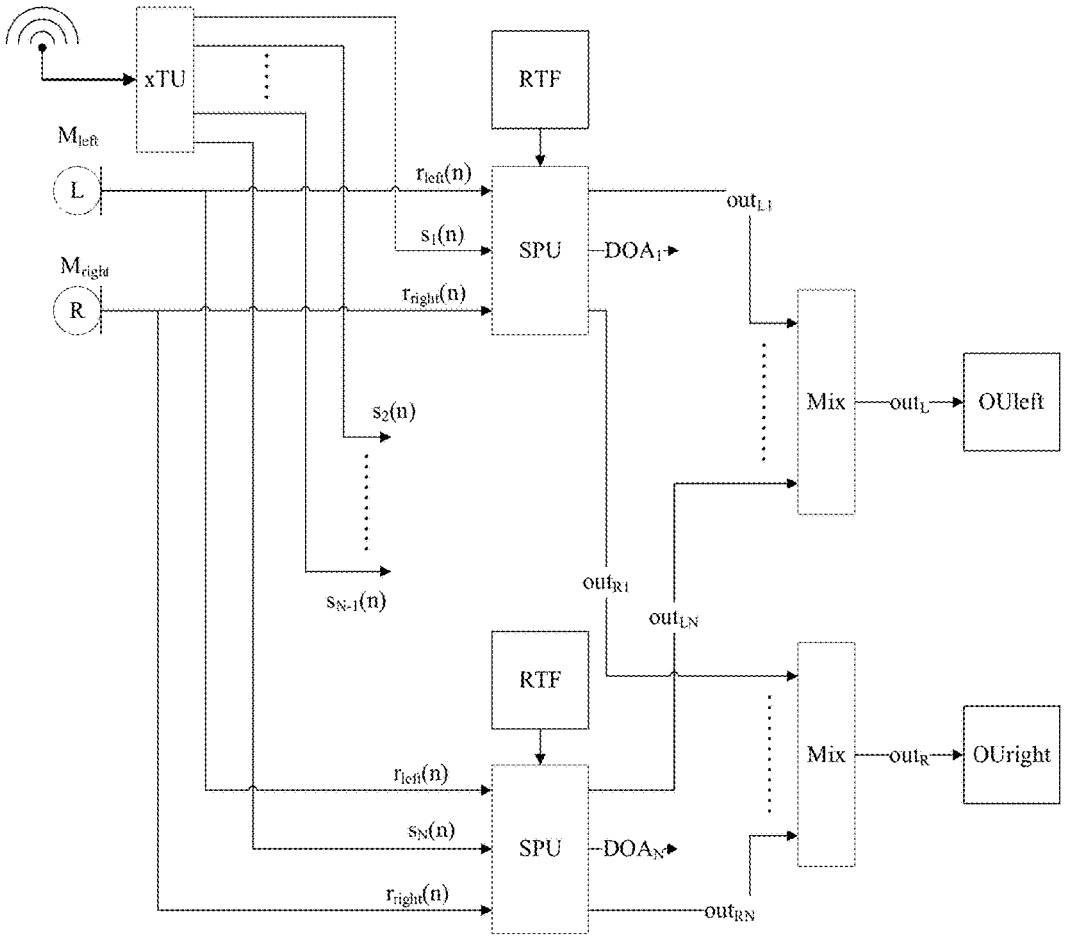
FIG. 11A shows a hearing system according to a fourth embodiment of the present disclosure, comprising left and right microphones providing left and right noisy target signals, respectively, and a number N of wirelessly received target sound signals from N target sound sources.

FIG. 11A shows a hearing system according to a fourth embodiment of the present disclosure, comprising left and right microphones ($M_{left}$ft, $M_{right}$) providing left and right noisy target signals ($r_{left}$(n), $r_{right}$(n)), respectively, n being a time index, and antenna and transceiver circuitry (xTU) providing a number N of wirelessly received (essentially noise-free) target sound signals $s_w$(n), w=1, . . . , N, from N target sound sources. The hearing system comprises one, or as illustrated a number N of, signal processor(s) (SPU) configured to provide N individual direction of arrivals (DoAs) $DOA_w$, w=1, . . . , N, according to the present disclosure, each DoA being based on the noisy target signals ($r_{left}$, $r_{right}$), and a different one of the wirelessly received target sound signals $s_w$, w=1, . . . , N. Individual dictionaries of RTFs (RTF) associated with a given one of the N target sound sources are available for the corresponding signal processor (SPU). As discussed in connection with FIG. 3A, 3B, 3C, and FIG. 4A, 4B for a single wirelessly received target sound source, FIG. 11A provides for each of the N target sound sources left and right processed signals $out_{Lw}$ and $out_{Rw}$, respectively. Each individual processed output signal, $out_{Lw}$ and $out_{Rw}$, has been processed according to the present disclosure and provided with appropriate spatial cues based on the relevant $DoA_w$. The N left and right processed output signal, $out_{Lw}$ and $out_{Rw}$, w=1, . . . , N, are fed to respective mixing units (Mix) providing resulting left and right output signals, $out_L$ and $out_R$, which are fed to respective left and right output units ($OU_{left}$ and $OU_{right}$), e.g. in left and right hearing devices, for presentation to a user.

Figure 11B:
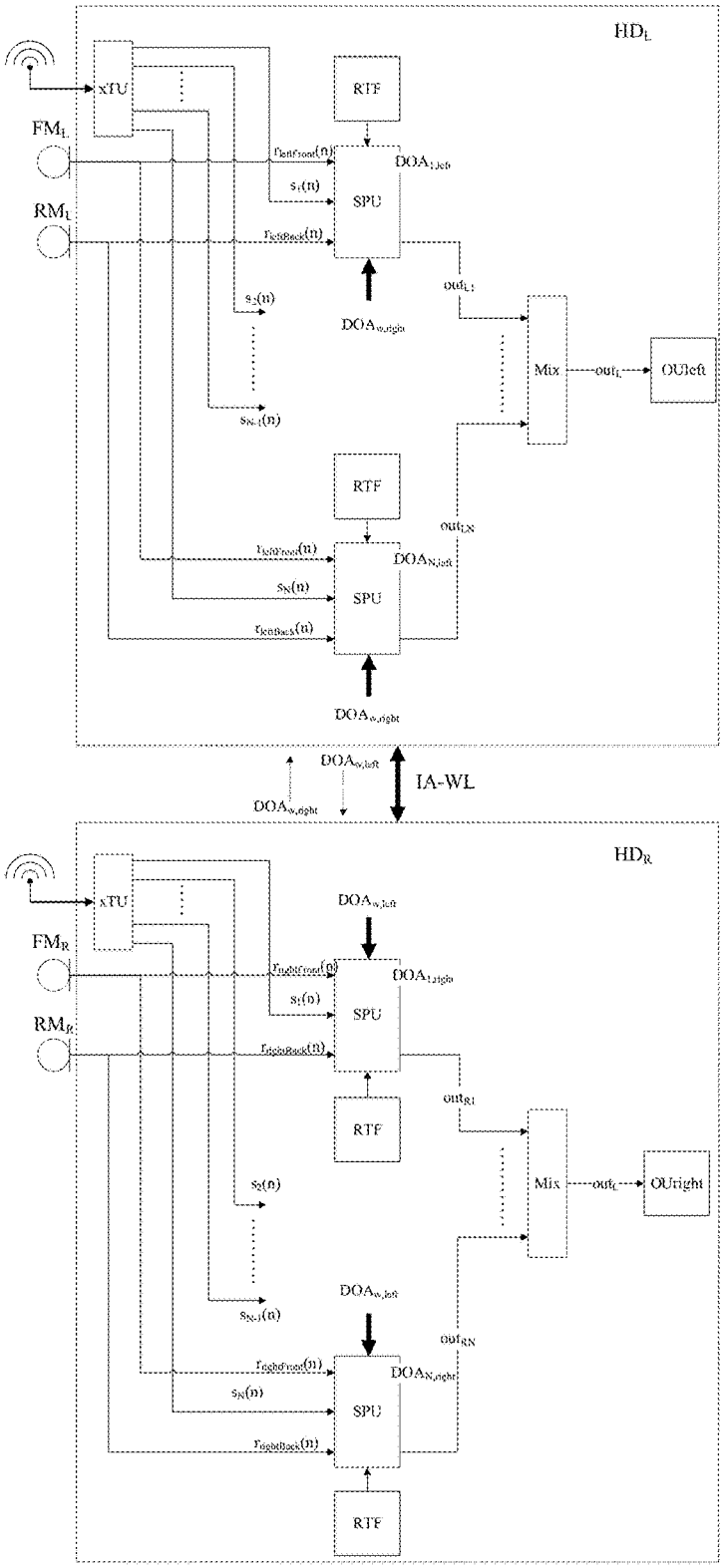
FIG. 11B shows a hearing system according to a fifth embodiment of the present disclosure, comprising left and right hearing devices each comprising front and back microphones providing left front and back and right front and back noisy target signals and, respectively, and each wirelessly receiving a number N of target sound signals from N target sound sources.

FIG. 11B shows a hearing system according to a fifth embodiment of the present disclosure, comprising left and right hearing devices ($HD_L$, $HD_R$) each comprising front and back microphones ($FM_L$, $RM_L$, and $FM_R$, $RM_R$, respectively) providing left front and back and right front and back noisy target signals ($r_{leftFront}$, $r_{leftBack}$) and ($r_{rightFront}$, $r_{rightBack}$), respectively, and each wirelessly receiving a number N of target sound signals $s_w$, w=1, . . . , N, from N target sound sources (via appropriate antenna and transceiver circuitry xTU), and providing N individual direction of arrivals $DoA_{w,left}$ and $DOA_{w,right}$, w=1, . . . , N, respectively, each being based on the noisy target signals ($r_{leftFront}$, $r_{leftBack}$) and ($r_{rightFront}$, $r_{rightBack}$), respectively, and a different one of the wirelessly received target sound signals $s_w$, w=1, . . . , N, wherein the N individual direction of arrivals $DoA_{w,left}$ and $DOA_{w,right}$, w=1, . . . , N, are exchanged between the left and right hearing devices ($HD_L$, $HD_R$) via an interaural wireless link IA-WL, compared and used in determining resulting DoAs for each of the wirelessly received target sources in the left and right hearing devices. The N resulting DoAs are used to determine appropriate resulting relative transfer functions, which are applied to the respective left and right wirelessly received target signals and providing respective N processed output signals $out_{Lw}$ and $out_{Rw}$, W=1, . . . , N, according to the present disclosure, as indicated in connection with FIG. 11A. Each hearing device comprises respective mixing units (Mix) providing resulting left and right output signals, $out_L$ and $out_R$, which are fed to respective left and right output units ($OU_{left}$ and $OU_{right}$) in the left and right hearing devices ($HD_L$, $HD_R$) comprising stimuli perceivable as sound by the user.

The embodiment of FIG. 11B combines two independently created directional of arrivals to a resulting (binaural) DoA, whereas FIG. 11A immediately determines joint (binaural) directional of arrivals. The approach of the embodiment of FIG. 11A requires access to the noisy target signals from both sides (requiring transfer of at least one audio signal, (bandwidth requirement), whereas the approach of the embodiment of FIG. 11B requires access to direction of arrival (or equivalent), but at the cost of parallel processing of DoAs in both hearing devices (processing power requirement).

The proposed method may be modified to take into account knowledge of the typical physical movements of sound sources. For example, the speed with which target sound sources change their position relative to the microphones of the hearing aids is limited: first, sound sources (typical humans) maximally move by a few m/s. Secondly, the speed with which the hearing aid user can turn his head is limited (since we are interested in estimating the DoA of target sound sources relative to the hearing aid microphones, which are mounted on the head of a user, head movements will change the relative positions of target sound sources). One might build such prior knowledge into the proposed method, e.g., by replacing the evaluation of RTS for all possible directions in the range [−90°—90°] to a smaller range for directions close to an earlier, reliable DoA estimate (or re-evaluate the estimate of $C_v$, e.g. if a movement of the head of the user has been detected). Further, the DoA estimation is described as a two dimensional problem (angle θ in a horizontal plane). The DoA may alternatively be determined in a three dimensional configuration, e.g. using spherical coordinates (θ, φ, r).

Further, default relative transfer functions RTF may be used in case that none of the RTFs stored in the memory are identified as particularly likely, such default RFTs e.g. corresponding to a default direction relative to the user, such as to the front of the user. Alternatively, a current direction may be maintained, in case no RTF is particularly likely at a given point in time. In an embodiment, the likelihood function (or the log likelihood function) may be smoothed across location (e.g. (θ, φ, r)) to include information from neighboring locations.

As the dictionary has limited resolution, and the DOA estimates may be smoothed over time, the proposed method may not be able to capture small head movements, which humans usually take advantage of in order to resolve front-back confusions. Thus the applied DOA may be fixed even though the person is doing small head movements. Such small movements may be detected by a movement sensor (such as an accelerometer, a gyroscope or a magnetometer), which is able to detect small movements much faster than the DOA estimator. The applied head related transfer function can thus be updated taking these small head movements into account. E.g. if the DOA is estimated with a resolution of 5 degrees in the horizontal plane, and then gyroscope can detect head movements with a finer resolution, e.g. 1 degree the transfer function may be adjusted based on a detected change of head direction relative to the estimated direction of arrival. The applied change may e.g. correspond to the minimum resolution in the dictionary (such as 10 degrees, such as five degrees, such as one degree) or the applied transfer function may be calculated by interpolation between two dictionary elements.

Figure 12:
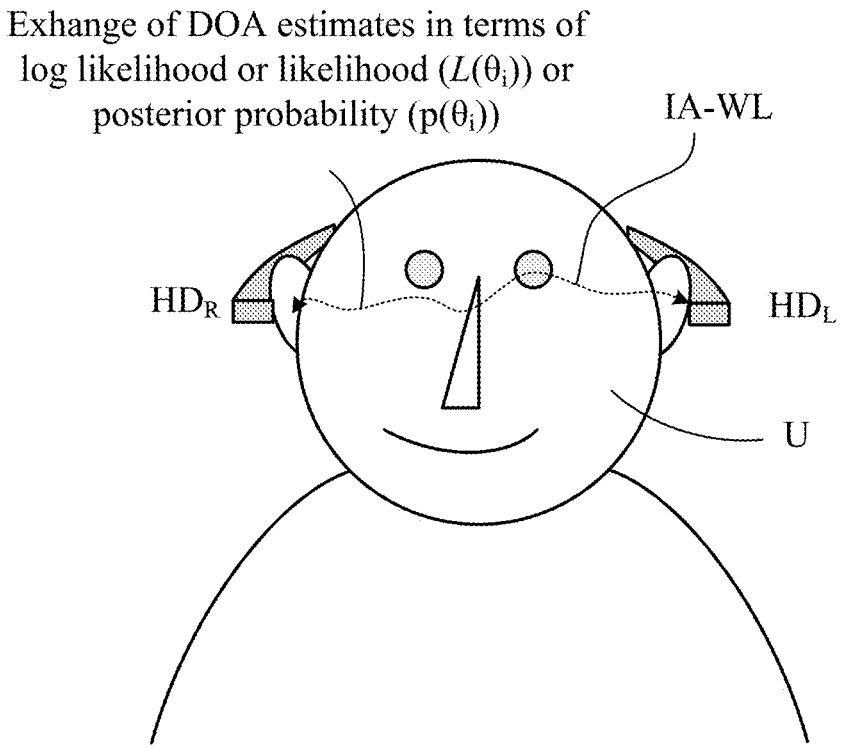
FIG. 12 shows a binaural hearing system comprising left and right hearing devices adapted to exchange of likelihood values between the left and right hearing devices for use in an estimation of a DoA to a target sound source.

FIG. 12 illustrates the general aspect of the present disclosure, namely a binaural hearing system comprising left and right hearing devices ($HD_L$, $HD_R$) adapted to exchange of likelihood values L between the left and right hearing devices for use in an estimation of a direction of arrival (DoA) to/from a target sound source. In an embodiment, only likelihood values ($L(\theta_i)$)), e.g. log likelihood values, or otherwise normalized likelihood values) for a number of direction of arrivals DoA (θ), e.g. qualified to a limited (realistic) angular range, e.g. $\theta\varepsilon[\theta_1;\ \theta_2]$ are exchanged between the left and right hearing devices ($HD_L$, $HD_R$). In an embodiment, the likelihood values, e.g. log-likelihood values are summed up to a threshold frequency, e.g. 4 kHz. In an embodiment, only noisy signals (comprising a target signal from a target sound source) picked up by microphones of the left and right hearing devices ($HD_L$, $HD_R$) are available for the DoA estimation in the binaural hearing system, as illustrated in FIG. 12. The embodiment of a binaural hearing system shown in FIG. 12 does not have access to a clean version of the target signal. In an embodiment, noisy signals comprising one or more target signals from one or more target sound sources as picked up by microphones of the left and right hearing devices ($HD_L$, $HD_R$) as well as 'clean' (less noisy) version(s) of the respective target signal(s) are available for the DoA estimation in the binaural hearing system. In an embodiment, a scheme for DoA estimation as described in the present disclosure is implemented in the binaural hearing system. The hearing devices ($HD_L$, $HD_R$) are shown in FIG. 12 as devices mounted at the ear (behind the ear) of a user (U). Other styles may be used, e.g. located completely in the ear (e.g. in the ear canal), fully or partly implanted in the head, etc. Each of the hearing instruments comprise a wireless transceiver to establish an interaural wireless link (IA-WL) between the hearing devices, here e.g. based on inductive communication, at least for receiving and/or transmitting signals e.g. control signals, e.g. information signals (e.g. present DoA, or likelihood values or probability values). Each of the hearing devices may further comprise a transceiver for establishing a wireless link (e.g. based on radiated fields) to an auxiliary device, at least for receiving and/or transmitting signals ($CNT_R$, $CNT_L$), e.g. control signals, e.g. information signals (e.g. present DoA, or likelihood values), e.g. including audio signals, e.g. for performing at least some of the processing related to DoA, and/or for implementing a user interface, cf. e.g. FIG. 9A, 9B.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[1]: "Bias-Compensated Sound Source Localization Using Relative Transfer Functions," M. Farmani, M. S. Pedersen, Z.-H. Tan, and J. Jensen, IEEE Trans. Audio, Speech, and Signal Processing, Vol. 26, No. 7, pp. 1271-1285, 2018.

[2]: EP3013070A2 (OTICON) 27 Apr. 2016.

[3]: EP3157268A1 (OTICON) 19 Apr. 2017.

[4]: Co-pending European patent application no. 16182987.4 filed on 5 Aug. 2016 having the title "A binaural hearing system configured to localize a sound source".

[5]: Co-pending European patent application no. 17160209.7 filed on 9 Mar. 2017 having the title "A hearing device comprising a wireless receiver of sound".

The invention claimed is:

1. A hearing system comprising a multitude of M of microphones, where M is larger than or equal to two, adapted for being located on a user and for picking up sound from the environment and to provide M corresponding electric input signals $r_m(n)$, m=1, . . . , M, n representing time, the environment sound at a given microphone comprising a mixture of a target sound signal propagated via an acoustic propagation channel from a location of a target sound source and possible noise signals $v_m(n)$ as present at the location of the microphone in question;

a transceiver configured to receive a wirelessly transmitted version of the target sound signal and providing an essentially noise-free target signal s(n);

a signal processor connected to said number of microphones and to said wireless transceiver, the signal processor being configured to estimate a direction-of-arrival of the target sound signal relative to the user based on a signal model for a received sound signal $r_m$ at microphone m (m=1, . . . , M) through the acoustic propagation channel from the target sound source to the $m^{th}$ microphone when worn by the user, wherein the $m^{th}$ acoustic propagation channel subjects the essentially noise-free target signal s(n) to an attenuation $\alpha_m$ and a delay $D_m$;

a maximum likelihood methodology;

relative transfer functions $d_m$ representing direction-dependent filtering effects of the head and torso of the user in the form of direction-dependent acoustic transfer functions from each of M−1 of said M microphones (m=1, . . . , M, m≠j) to a reference microphone (m=j) among said M microphones, wherein said attenuation $\alpha_m$ is assumed to be independent of frequency whereas said delay $D_m$ is assumed to be frequency dependent.

2. A hearing system according to claim 1 wherein the signal model can be expressed as $$r_m(n)=s(n)*h_m(n,\theta)+v_m(n),(m=1, \ldots ,M)$$

where s(n) is the essentially noise-free target signal emitted by the target sound source, $h_m(n, \theta)$ is the acoustic channel impulse response between the target sound source and microphone m, and $v_m(n)$ is an additive noise component, θ is an angle of a direction-of-arrival of the target sound source relative to a reference direction defined by the user and/or by the location of the microphones at the user, n is a discrete time index, and * is the convolution operator.

3. A hearing system according to claim 1 configured to provide that the signal processor has access to a database Θ of relative transfer functions $d_m(k)$ for different directions (θ) relative to the user.

4. A hearing system according to claim 1 comprising at least one hearing device, e.g. a hearing aid, adapted for being worn at or in an ear, or for being fully or partially implanted in the head at an ear, of a user.

5. A hearing system according to claim 1 comprising left and right hearing devices, e.g. hearing aids, adapted for being worn at or in left and right ears, respectively, of a user, or for being fully or partially implanted in the head at the left and right ears, respectively, of the user.

6. A hearing system according to claim 1 wherein the signal processor is configured to provide a maximum-likelihood estimate of the direction of arrival θ of the target sound signal.

7. A hearing system according to claim 1 wherein the signal processor(s) is(are) configured to provide a maximum-likelihood estimate of the direction of arrival θ of the target sound signal by finding the value of θ, for which a log likelihood function is maximum, and wherein the expression for the log likelihood function is adapted to allow a calculation of individual values of the log likelihood function for different values of the direction-of-arrival (θ) using a summation over a frequency variable k.

8. A hearing system according to claim 5 comprising one or more weighting units for providing a weighted mixture of said essentially noise-free target signal s(n) provided with appropriate spatial cues, and one or more of said electric input signals or processed versions thereof.

9. A hearing system according to claim 1 wherein at least one of the left and right hearing devices is or comprises a hearing aid, a headset, an earphone, an ear protection device or a combination thereof.

10. A hearing system according to claim 6 configured to provide a bias compensation of the maximum-likelihood estimate.

11. A hearing system according to claim 1 comprising a movement sensor configured to monitor movements of the user's head.

12. Use of a hearing system as claimed in claim 1 to apply spatial cues to a wirelessly received essentially noise-free target signal from a target sound source.

13. Use of a hearing system as claimed in claim 12 in a multi-target sound source situation to apply spatial cues to two or more wirelessly received essentially noise-free target signals from two or more target sound sources.

14. A method of operating a hearing system comprising left and right hearing devices adapted to be worn at left and right ears of a user, the method comprising providing M electric input signals $r_m(n)$, m=1, . . . , M, where M is larger than or equal to two, n representing time, said M electric input signals representing environment sound at a given microphone location and comprising a mixture of a target sound signal propagated via an acoustic propagation channel from a location of a target sound source and possible noise signals $v_m(n)$ as present at the location of the microphone location in question;

receiving a wirelessly transmitted version of the target sound signal and providing an essentially noise-free target signal s(n);

processing said M electric input signals said essentially noise-free target signal;

estimating a direction-of-arrival of the target sound signal relative to the user based on a signal model for a received sound signal $r_m$ at microphone m (m=1, . . . , M) through the acoustic propagation channel from the target sound source to the $m^{th}$ microphone when worn by the user, wherein the $m^{th}$ acoustic propagation channel subjects the essentially noise-free target signal s(n) to an attenuation $\alpha_m$ and a delay $D_m$;

a maximum likelihood methodology;

relative transfer functions $d_m$ representing direction-dependent filtering effects of the head and torso of the user in the form of direction-dependent acoustic transfer functions from each of M−1 of said M microphones (m=1, . . . , M, m≠j) to a reference microphone (m=j) among said M microphones, under the constraints that said attenuation $\alpha_m$ is independent of frequency whereas said delay $D_m$ is frequency dependent.

15. A data processing system comprising a processor and program code means for causing the processor to perform the steps of the method of claim 14.

16. A computer program comprising instructions which, when the program is executed by a computer, cause the computer to carry out the method as claimed in claim 14.

17. A non-transitory application, termed an APP, comprising executable instructions configured to be executed on an auxiliary device to implement a user interface for a hearing device according to claim 1.

18. A non-transitory application according to claim 17 configured to run on cellular phone, e.g. a smartphone, or on another portable device allowing communication with said hearing device or said hearing system.

19. A non-transitory application according to claim 17 wherein the user interface is configured to select a mode of operation of the hearing system where spatial cues are added to audio signals streamed to the left and right hearing devices.

20. A non-transitory application according to claim 17 configured to allows a user to select one or more of a number of available streamed audio sources via the user interface.

* * * * *